US010315413B2

(12) United States Patent
Yoshino

(10) Patent No.: US 10,315,413 B2
(45) Date of Patent: Jun. 11, 2019

(54) DRIVE CIRCUIT, LIQUID EJECTION DEVICE, AND CONTROL METHOD OF DRIVE CIRCUIT

(71) Applicant: SEIKO EPSON CORPORATION, Tokyo (JP)

(72) Inventor: Hiroyuki Yoshino, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 2 days.

(21) Appl. No.: 15/696,820

(22) Filed: Sep. 6, 2017

(65) Prior Publication Data

US 2018/0093473 A1 Apr. 5, 2018

(30) Foreign Application Priority Data

Sep. 30, 2016 (JP) ..... 2016-193306

(51) Int. Cl.
*B41J 2/045* (2006.01)

(52) U.S. Cl.
CPC ..... *B41J 2/04541* (2013.01); *B41J 2/04581* (2013.01); *B41J 2/04588* (2013.01)

(58) Field of Classification Search
None
See application file for complete search history.

(56) References Cited

U.S. PATENT DOCUMENTS

| | | | | |
|---|---|---|---|---|
| 7,244,007 | B2 | 7/2007 | Ishizaki | |
| 2005/0231179 | A1 | 10/2005 | Ishizaki | |
| 2006/0061304 | A1* | 3/2006 | Cho | H05B 41/2822 315/307 |
| 2011/0234702 | A1* | 9/2011 | Oshima | H03F 3/2171 347/54 |
| 2012/0120136 | A1* | 5/2012 | Oshima | B41J 2/04541 347/10 |

FOREIGN PATENT DOCUMENTS

| | | | |
|---|---|---|---|
| JP | 2005-329710 | A | 12/2005 |
| JP | 2013-176936 | A | 9/2013 |

* cited by examiner

*Primary Examiner* — Erica S Lin
(74) *Attorney, Agent, or Firm* — Oliff PLC

(57) ABSTRACT

A drive circuit includes a signal generating circuit that generates drive waveform signal, an arithmetic circuit that generates difference signal representing a difference between the drive waveform signal and a feedback signal, a modulation circuit that modulates the difference signal pulse to generate modulated signal, a digital power amplifier circuit that amplifies the modulated signal to generate amplified signal, a smoothing circuit that smoothes the amplified signal to generate drive signal, a compensation circuit that generates the feedback signal based on the drive signal, and a voltage generating circuit that is connected to wiring between the digital power amplifier circuit and the capacitive load and generates a first voltage that exceeds a voltage range in which a pulse frequency of the modulated signal does not vary with respect to voltage variation of the drive signal, the drive signal being supplied to the capacitive load after the first voltage.

10 Claims, 21 Drawing Sheets

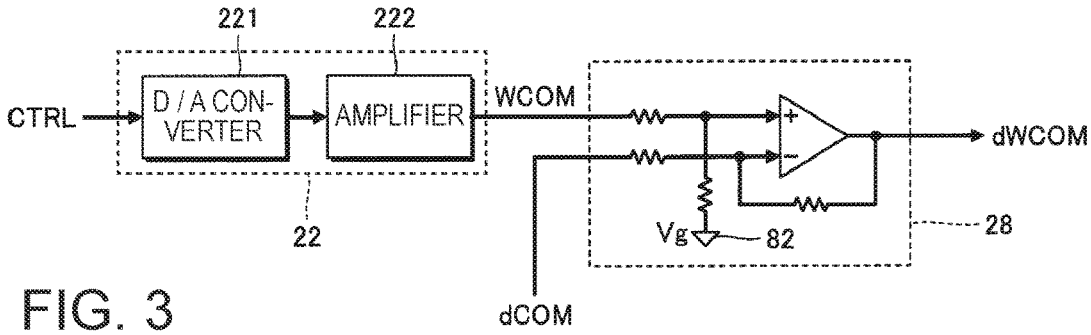
FIG. 3
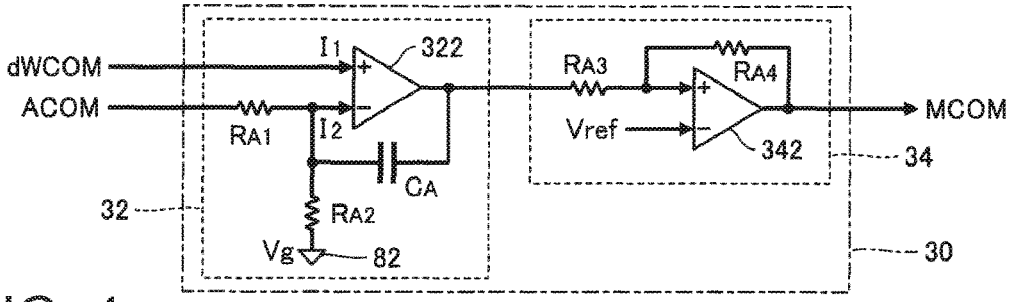
FIG. 4
FIG. 5
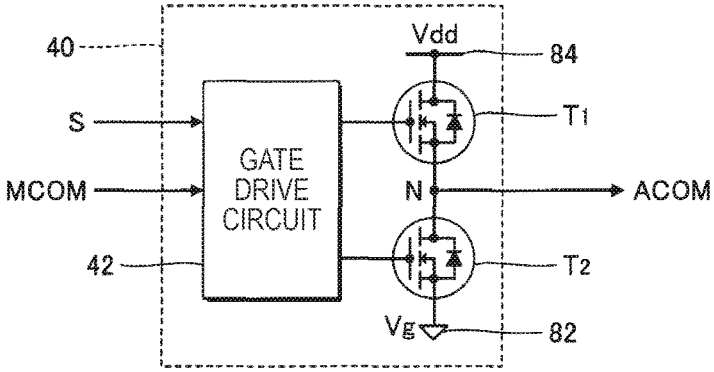
FIG. 6
| | | |
|---|---|---|
| S=H | STOP STATE | T1:OFF, T2:OFF |
| S=L | OPERATION STATE | MCOM=H ··· T1:ON, T2:OFF<br>MCOM=L ··· T1:OFF, T2:ON |

FIG. 8
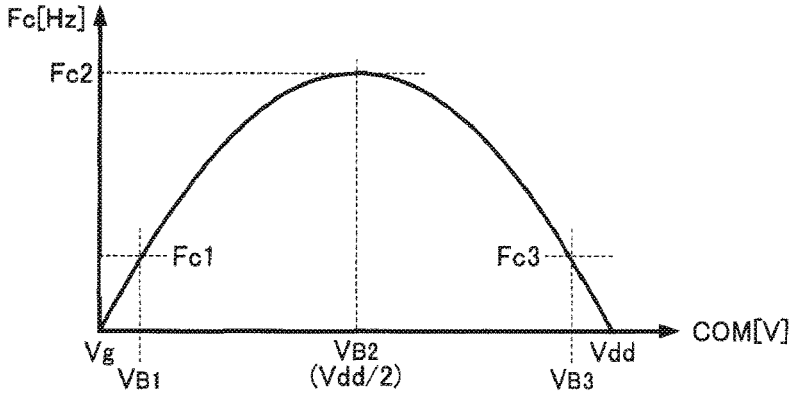
FIG. 9
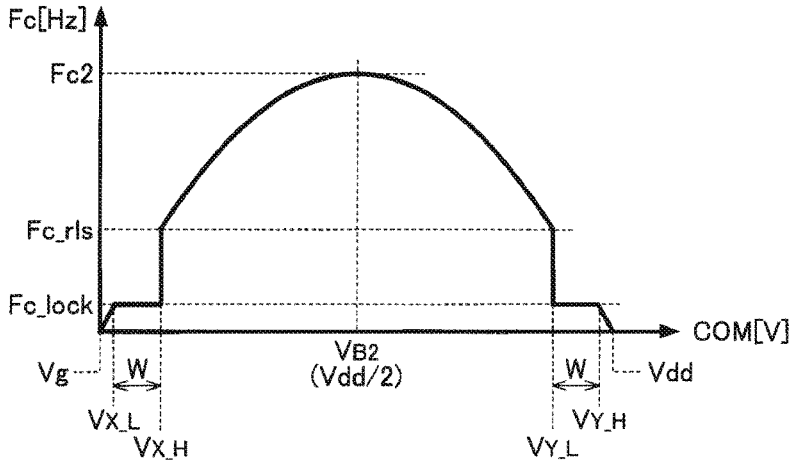
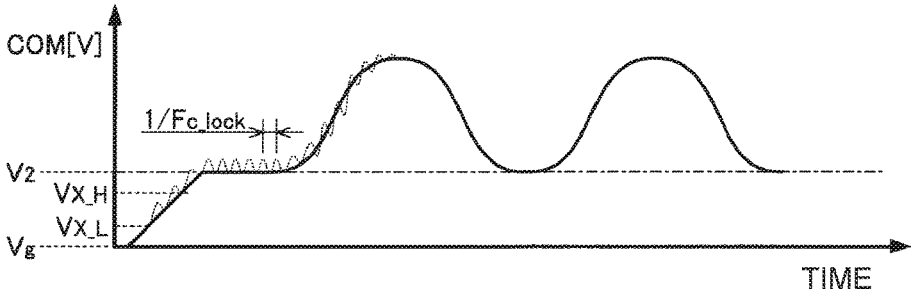
FIG.10

DRIVE CIRCUIT, LIQUID EJECTION DEVICE, AND CONTROL METHOD OF DRIVE CIRCUIT

BACKGROUND

1. Technical Field

The present invention relates to a technique to drive a capacitive load such as a piezoelectric element.

2. Related Art

Various techniques for generating a drive signal for driving a capacitive load such as a piezoelectric element have been proposed in the related art. For example, JP-A-2005-329710 discloses a drive circuit including an arithmetic amplifier that generates a difference signal (error signal) representing a difference between an input signal and a feedback signal, a pulse width modulator that modulates a pulse width of the difference signal, a digital power amplifier that amplifies the modulated signal, and a filter that generates a drive signal by smoothing the amplified signal. The feedback signal that advances a phase of the smoothed signal is fed back to the arithmetic amplifier.

By the way, in a case where pulse modulation is performed under the configuration of JP-A-2005-329710, which feeds back a drive signal, a voltage of the drive signal may vary unstably.

SUMMARY

An advantage of some aspects of the invention is to suppress the voltage variation caused by feedback of the drive signal and pulse modulation for the drive signal supplied to the capacitive load by considering the above circumstances.

A drive circuit according to a preferred aspect of the invention is a drive circuit that generates a drive signal supplied to a capacitive load and includes a signal generating circuit that generates a drive waveform signal, an arithmetic circuit that generates a difference signal representing a difference between the drive waveform signal and a feedback signal, a modulation circuit that modulates a pulse of the difference signal to generate a modulated signal, a digital power amplifier circuit that amplifies the modulated signal to generate an amplified signal, a smoothing circuit that smoothes the amplified signal to generate a drive signal, a compensation circuit that generates the feedback signal based on the drive signal, and a voltage generating circuit that is connected to a wiring between the digital power amplifier circuit and the capacitive load and generates a first voltage that is a voltage exceeding a voltage range in which a pulse frequency of the modulated signal does not vary with respect to voltage variation of the drive signal, in which the drive signal generated by operation of the digital power amplifier circuit is supplied to the capacitive load after the first voltage is supplied to the capacitive load as the drive signal. With the above configuration, in a state in which the operation of the digital power amplifier circuit is stopped, the operation of the digital power amplifier circuit is started after the signal generating circuit generates a drive waveform signal where the drive signal becomes a second voltage exceeding a voltage range and the drive signal is set to the first voltage. Therefore, it is possible to suppress the voltage variation of the drive signal caused by the self-oscillation as compared with the configuration in which the digital power amplifier circuit is operated from the start of generation of the drive signal.

In the preferred aspect of the invention, it is preferable that the signal generating circuit generates the drive waveform signal in which the drive signal becomes a second voltage exceeding the voltage range in a case where the drive signal generated by operation of the digital power amplifier circuit is supplied to the capacitive load. In a more preferred aspect, the signal generating circuit generates the drive waveform signal in which the drive signal becomes the second voltage exceeding the voltage range in a state in which the operation of the digital power amplifier circuit is stopped.

The relationship (different) between the first voltage and the second voltage is not an issue. For example, in the preferred aspect of the invention, the second voltage is a voltage equal to or higher than the first voltage. In addition, a configuration in which the second voltage is lower than the first voltage may be adopted.

In the preferred aspect in which the second voltage is lower than the first voltage, it is preferable that the voltage generating circuit includes a backflow preventing element having one terminal connected to a voltage line to which a predetermined voltage is supplied and generates the first voltage from the voltage generated at the other terminal of the backflow preventing element, in which the digital power amplifier circuit includes a first transistor provided between a first wiring to which a voltage on a high-level side is applied and an output point that outputs the amplified signal, a second transistor provided between a second wiring to which a voltage on a low-level side lower than the voltage on the high-level side is applied and the output point, and a capacitive element provided between the other terminal of the backflow preventing element and the first transistor source. With this configuration, a predetermined voltage used by the voltage generating circuit to generate the first voltage is also used to charge the capacitive element disposed between the other terminal of the backflow preventing element and the first transistor source. Therefore, there is an advantage that the configuration of the drive circuit is simplified as compared with a configuration using separate voltages for generation of the first voltage and charging of the capacitive element.

In the preferred aspect of the invention, it is preferable that the modulation circuit includes an arithmetic amplifier having a first input terminal to which the difference signal is input and a second input terminal to which the amplified signal or the modulated signal is input and a resistance element connected to the second input terminal, in which the voltage generating circuit generates the first voltage by dividing a voltage using the resistance element. With this configuration, the resistance element constituting the modulation circuit is also used for generation of the first voltage by the voltage generating circuit. Therefore, there is an advantage that the configuration of the drive circuit is simplified in comparison with a configuration using a resistance element separate from the resistance element of the modulation circuit for generation of the first voltage.

A liquid ejection device according to a preferred aspect of the invention includes a liquid chamber filled with liquid, a nozzle communicating with the liquid chamber, a piezoelectric element that applies pressure to the liquid in the liquid chamber, and a drive circuit that generates a drive signal supplied to the piezoelectric element, in which the drive circuit includes a signal generating circuit that generates a drive waveform signal, an arithmetic circuit that generates a difference signal representing a difference between the drive waveform signal and a feedback signal, a modulation circuit that modulates a pulse of the difference signal to generate a modulated signal, a digital power amplifier circuit that amplifies the modulated signal to generate an amplified signal, a smoothing circuit that smoothes the amplified signal to generate the drive signal, a compensation circuit that generates the feedback signal based on the drive signal, and a voltage generating circuit that is connected to a wiring between the digital power amplifier circuit and the capacitive load and generates a first voltage that is a voltage exceeding a voltage range in which a pulse frequency of the modulated signal does not vary with respect to voltage variation of the drive signal, and the drive signal generated by operation of the digital power amplifier circuit is supplied to the capacitive load after the first voltage is supplied to the capacitive load.

A method of controlling according to a preferred aspect of the invention is a method of controlling a drive circuit that generates a drive signal supplied to a capacitive load, in which the drive circuit includes a signal generating circuit that generates a drive waveform signal, an arithmetic circuit that generates a difference signal representing a difference between the drive waveform signal and a feedback signal, a modulation circuit that modulates a pulse of the difference signal to generate a modulated signal, a digital power amplifier circuit that amplifies the modulated signal to generate an amplified signal, a smoothing circuit that smoothes the amplified signal to generate the drive signal, a compensation circuit that generates the feedback signal based on the drive signal, and a voltage generating circuit that is connected to a wiring between the digital power amplifier circuit and the capacitive load and generates a first voltage that is a voltage exceeding a voltage range in which a pulse frequency of the modulated signal does not vary with respect to the voltage variation of the drive signal, and the drive signal generated by operation of the digital power amplifier circuit is supplied to the capacitive load after the first voltage is supplied to the capacitive load.

BRIEF DESCRIPTION OF THE DRAWINGS

The invention will be described with reference to the accompanying drawings, wherein like numbers reference like elements.

FIG. 3 is a configuration diagram of a signal generating circuit and an arithmetic circuit.

FIG. 4 is a configuration diagram of a modulation circuit.

FIG. 5 is a configuration diagram of a digital power amplifier circuit.

FIG. 6 is an explanatory diagram of an operation of the amplifier circuit.

FIG. 8 is an explanatory diagram of an ideal relationship between a voltage of the drive signal and a self-oscillating carrier frequency.

FIG. 9 is an explanatory diagram of an actual relationship between the voltage of the drive signal and the self-oscillating carrier frequency.

FIG. 10 is an explanatory diagram of a problem in which a waveform of the drive signal unstably varies.

DESCRIPTION OF EXEMPLARY EMBODIMENTS

First Embodiment

Figure 1:
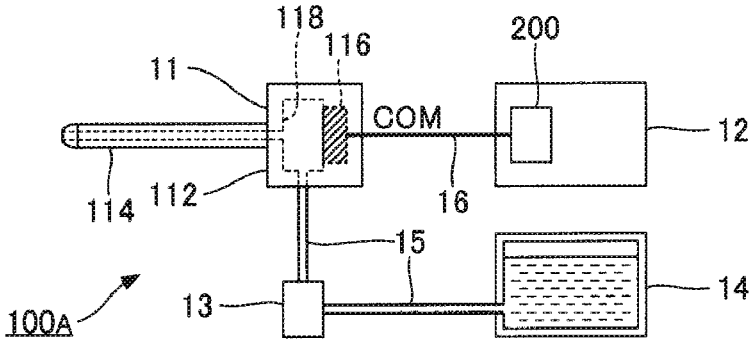
FIG. 1 is a configuration diagram of a liquid ejection device in a first embodiment.

FIG. 1 is a configuration diagram of a liquid ejection device 100A according to a first embodiment of the invention. The liquid ejection device 100A of the first embodiment is a surgical medical apparatus (water jet scalpel) for cutting living tissue by ejection of liquid, and as illustrated in FIG. 1, includes a liquid ejection unit 11 and a control unit 12, a supply pump 13, and a liquid container 14. The liquid ejection unit 11 and the liquid container 14 are connected by a pipeline 15, and the liquid ejection unit 11 and the control unit 12 are electrically connected by a signal line 16. The liquid container 14 is a container for storing liquid (for example, pure water, physiological saline solution, or chemical liquid). The supply pump 13 supplies the liquid stored in the liquid container 14 to the liquid ejection unit 11 via the pipeline 15.

The liquid ejection unit 11 ejects liquid supplied from the liquid container 14 under the control of the control unit 12. The liquid ejection unit 11 of the first embodiment includes a casing portion 112, a nozzle 114, and a piezoelectric element 116. A liquid chamber 118 is formed inside the casing portion 112 gripped by a user such as a doctor. The liquid chamber 118 is filled with the liquid supplied from the liquid container 14 via the pipeline 15. The nozzle 114 is a pipeline communicating with the liquid chamber 118. The piezoelectric element 116 is, for example, a capacitive load having a structure in which a piezoelectric body is sandwiched between a pair of mutually opposed electrodes, and is deformed by supplying a drive signal COM from the control unit 12. In association with the operation of the piezoelectric element 116, the liquid chamber 118 is elastically deformed so that pressure is applied to the liquid in the liquid chamber 118, and as a result, liquid is ejected from a tip of the nozzle 114. Specifically, liquid droplets are periodically ejected from the tip of the nozzle 114.

The control unit 12 controls the liquid ejection unit 11. The control unit 12 of the first embodiment includes a drive circuit 200. The drive circuit 200 is an electrical circuit that generates and outputs the drive signal COM for driving the piezoelectric element 116. In a case where liquid droplets are periodically ejected from the tip of the nozzle 114, the drive circuit 200 outputs a periodic signal whose voltage varies at a predetermined cycle as the drive signal COM. The drive signal COM output from the control unit 12 is supplied to the liquid ejection unit 11 via the signal line 16.

Figure 2:
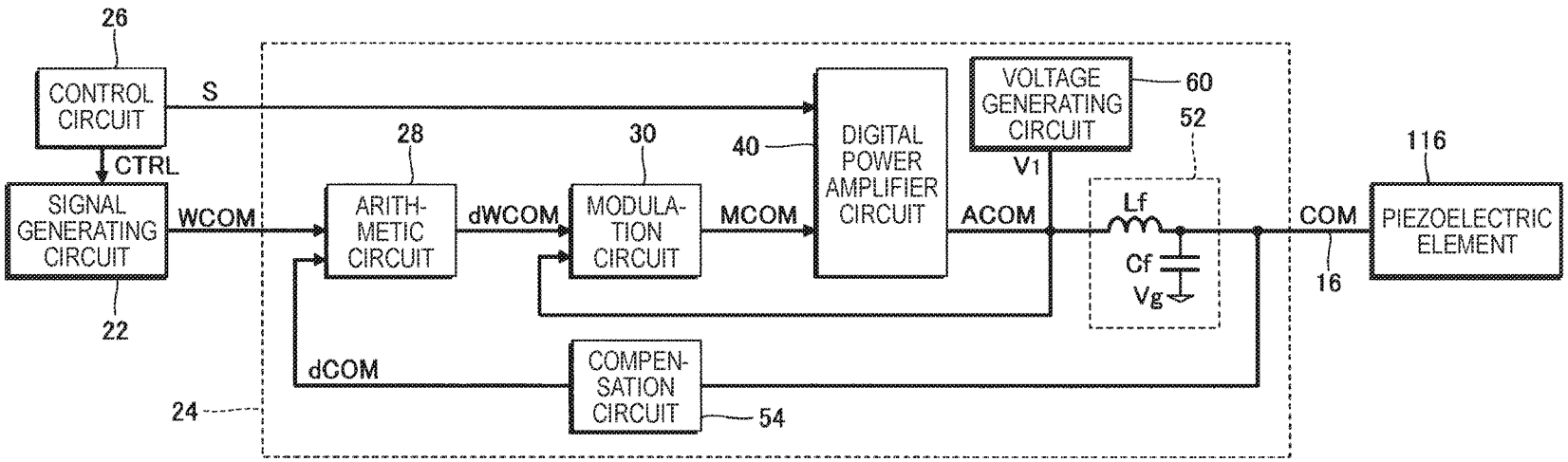
FIG. 2 is a configuration diagram of a drive circuit.

FIG. 2 is a configuration diagram illustrating the drive circuit 200. As illustrated in FIG. 2, the drive circuit 200 of the first embodiment includes a signal generating circuit 22, an amplifier circuit 24, and a control circuit 26. The signal generating circuit 22 generates an analog drive waveform signal WCOM underlying the drive signal COM which is supplied (applied) to the piezoelectric element 116. As illustrated in FIG. 3, the signal generating circuit 22 is configured to include, for example, a D/A converter 221 that converts waveform indication data CTRL supplied from the control circuit 26 to an analog signal, and an amplifier 222 that amplifies the converted signal to generate the drive waveform signal WCOM (pre-amplifier). It is also possible to omit the amplifier 222.

The control circuit 26 in FIG. 2 is configured with an arithmetic processing circuit such as a central processing unit (CPU) or a field-programmable gate array (FPGA), for example, and controls the overall operation of the drive circuit 200. Specifically, the control circuit 26 supplies the waveform indication data CTRL representing the waveform of the drive waveform signal WCOM to the signal generating circuit 22. In addition, the control circuit 26 of the first embodiment generates a control signal S for controlling the operation of the amplifier circuit 24 and supplies the signal to the amplifier circuit 24. It is also possible for a separate circuit to generate the waveform indication data CTRL and the control signal S.

The amplifier circuit 24 in FIG. 2 is a class D amplifier that generates the drive signal COM by amplifying the drive waveform signal WCOM generated by the signal generating circuit 22. The drive signal COM amplified by the amplifier circuit 24 is supplied to the piezoelectric element 116 of the liquid ejection unit 11 via the signal line 16.

As illustrated in FIG. 2, the amplifier circuit 24 of the first embodiment includes an arithmetic circuit 28, a modulation circuit 30, a digital power amplifier circuit 40, a smoothing circuit 52, a compensation circuit 54, and a voltage generating circuit 60. The arithmetic circuit 28 generates a difference signal dWCOM according to the drive waveform signal WCOM generated by the signal generating circuit 22 and a feedback signal dCOM supplied from the compensation circuit 54. The difference signal dWCOM is a signal representing the difference (WCOM−dCOM) between the drive waveform signal WCOM and the feedback signal dCOM. As illustrated in FIG. 3, the arithmetic circuit 28 is configured with, for example, a combination of an arithmetic amplifier and a plurality of resistance elements.

The modulation circuit 30 in FIG. 2 modulates the pulse of the difference signal dWCOM to generate a modulated signal MCOM. The modulated signal MCOM is a binary pulse train whose duty ratio changes according to the voltage of the difference signal dWCOM. The digital power amplifier circuit generates an amplified signal ACOM by amplifying the modulated signal MCOM generated by the modulation circuit 30 by switching operation. The amplified signal ACOM is a binary pulse train that increases the voltage amplitude of the modulated signal MCOM. The smoothing circuit 52 is a low pass filter that smoothes the amplified signal ACOM generated by the digital power amplifier circuit 40 to generate the drive signal COM and is configured to include a capacitive element Cf and an inductor Lf as illustrated in FIG. 2. Smoothing as used herein refers to attenuating high frequency components contained in the amplified signal ACOM through the smoothing circuit 52 (low pass filter). By this smoothing, the amplified signal ACOM, which is a pulse signal, is demodulated, and the drive signal COM, which is an analog signal, is generated.

The drive signal COM generated by the smoothing circuit 52 is supplied to the piezoelectric element 116 of the liquid ejection unit 11 and fed back to the input side of the amplifier circuit 24. The compensation circuit 54 is disposed in a feedback path of the drive signal COM and generates the feedback signal dCOM by advancing the phase of the drive signal COM. As described above, the feedback signal dCOM generated by the compensation circuit 54 is supplied to the arithmetic circuit 28 and used to generate the difference signal dWCOM. As described above, by advancing the phase of the drive signal COM to feed back, the peak in the frequency characteristic of the gain of the amplifier circuit 24 (a resonance peak of the capacitive element Cf and the inductor Lf included in the smoothing circuit 52) is suppressed.

FIG. 4 is a configuration diagram of a concrete example of the modulation circuit 30. As illustrated in FIG. 4, the modulation circuit 30 of the first embodiment is a self-oscillating type pulse modulation circuit which feeds back and inputs the amplified signal ACOM. The self-oscillating type means a form in which a signal is oscillated by feeding its own output back to its own input. In the present embodiment, the self-oscillation type pulse modulation circuit is adopted, but a triangular comparison pulse type modulation circuit may be adopted as another scheme.

As illustrated in FIG. 4, the modulation circuit 30 of the first embodiment includes an integration circuit 32 and a comparison circuit 34. The integration circuit 32 includes an arithmetic amplifier 322, a resistance element RA1, a resistance element RA2, and a capacitive element CA. The difference signal dWCOM generated by the arithmetic circuit 28 is supplied to a plus side input terminal (exemplified as a first input terminal) I1 of the arithmetic amplifier 322, and the amplified signal ACOM generated by the digital power amplifier circuit 40 is supplied to a minus side input terminal (exemplified as a second input terminal) I2 via the resistance element RA1. The capacitive element CA is interposed between the minus side input terminal I2 of the arithmetic amplifier 322 and the output terminal. In addition, the minus side input terminal I2 is connected to a reference line 82 of a reference potential Vg (for example, a ground potential) via the resistance element RA2. With the above configuration, the integration circuit 32 outputs a signal obtained by integrating the difference between the difference signal dWCOM and the amplified signal ACOM.

The comparison circuit 34 includes a comparator 342, a resistance element RA3, and a resistance element RA4. The output voltage of the integration circuit 32 is supplied via the resistance element RA3 to the plus side input terminal of the comparator 342, and a predetermined voltage Vref is supplied to a minus side input terminal of the comparator 342. The resistance element RA4 is interposed between the plus side input terminal and an output terminal. With the above configuration, the comparison circuit 34 generates the binary modulated signal MCOM according to the level of the output voltage of the integration circuit 32 and the predetermined voltage Vref. Specifically, in a case where the output voltage of the integration circuit 32 exceeds the predetermined voltage Vref, the modulated signal MCOM is set to a predetermined voltage Vsig (a high level higher than the reference potential Vg). On the other hand, in a case where the output voltage of the integration circuit 32 is lower than the predetermined voltage Vref, the modulated signal MCOM is set to the reference potential Vg.

FIG. 5 is a configuration diagram illustrating the digital power amplifier circuit 40. As shown in FIG. 5, the digital power amplifier circuit 40 of the first embodiment includes a gate drive circuit 42, a first transistor T1, and a second transistor T2. The gate drive circuit 42 controls the states (ON state/OFF state) of the first transistor T1 and the second transistor T2. The control signal S generated by the control circuit 26 is supplied to the gate drive circuit 42.

The first transistor T1 and the second transistor T2 are switching elements such as a metal oxide semiconductor field effect transistor (MOSFET), for example. A point N at which the amplified signal ACOM is output (hereinafter, referred to as an "output point") is exemplified in FIG. 5. As illustrated in FIG. 5, the first transistor T1 is disposed between a power supply line 84 (an example of a first wiring) to which a power supply voltage Vdd (an example of a potential on a high-level side) is applied and the output point N. The second transistor T2 is disposed between a reference line 82 (an example of a second wiring) to which the reference potential Vg (an example of a potential on a low-level side) is applied and the output point N. The power supply voltage Vdd is a voltage generated with reference to the reference potential Vg.

The digital power amplifier circuit 40 of the first embodiment is controlled to an operation state and a stop state according to the control signal S supplied from the control circuit 26. FIG. 6 is an explanatory diagram of an example of the relationship between the state of the digital power amplifier circuit 40 and the control signal S. As illustrated in FIG. 6, the digital power amplifier circuit 40 of the first embodiment is controlled to be in the operation state when the control signal S is set to a low level, and when the control signal S is set to a high level, the digital power amplifier circuit 40 is controlled to be in the stop state (shutdown state).

In the operation state, the gate drive circuit 42 selectively controls either the first transistor T1 or the second transistor T2 to be in an ON state according to the modulated signal MCOM supplied from the modulation circuit 30. Specifically, as illustrated in FIG. 6, in a case where the modulated signal MCOM is at the voltage Vsig (high level), the gate drive circuit 42 controls the first transistor T1 to be in an ON state and the second transistor T2 to be in an OFF state. In the above state, since the power supply line 84 is connected to the output point N via the first transistor T1, the amplified signal ACOM is set to the power supply voltage Vdd. On the other hand, in a case where the modulated signal MCOM is the reference potential Vg (low level: voltage zero volt), the gate drive circuit 42 controls the first transistor T1 to be in an OFF state and the second transistor T2 to be in an ON state. Therefore, the amplified signal ACOM is set to the reference potential Vg (voltage zero volt). In addition, in order to prevent the first transistor T1 and the second transistor T2 from being in an ON state at the same time, a timing at which the modulated signal MCOM changes from the high level to the low level or a timing at which the modulated signal MCOM changes from the low level to the high level may be within a dead time period in which the first transistor T1 and the second transistor T2 are simultaneously in an OFF state.

On the other hand, in the stopped state, the gate drive circuit 42 controls both the first transistor T1 and the second transistor T2 to be in an OFF state. That is, the output point N is electrically insulated from both of the power supply line 84 and the reference line 82, and the modulated signal MCOM is not reflected on the voltage of the output point N.

Figure 7:
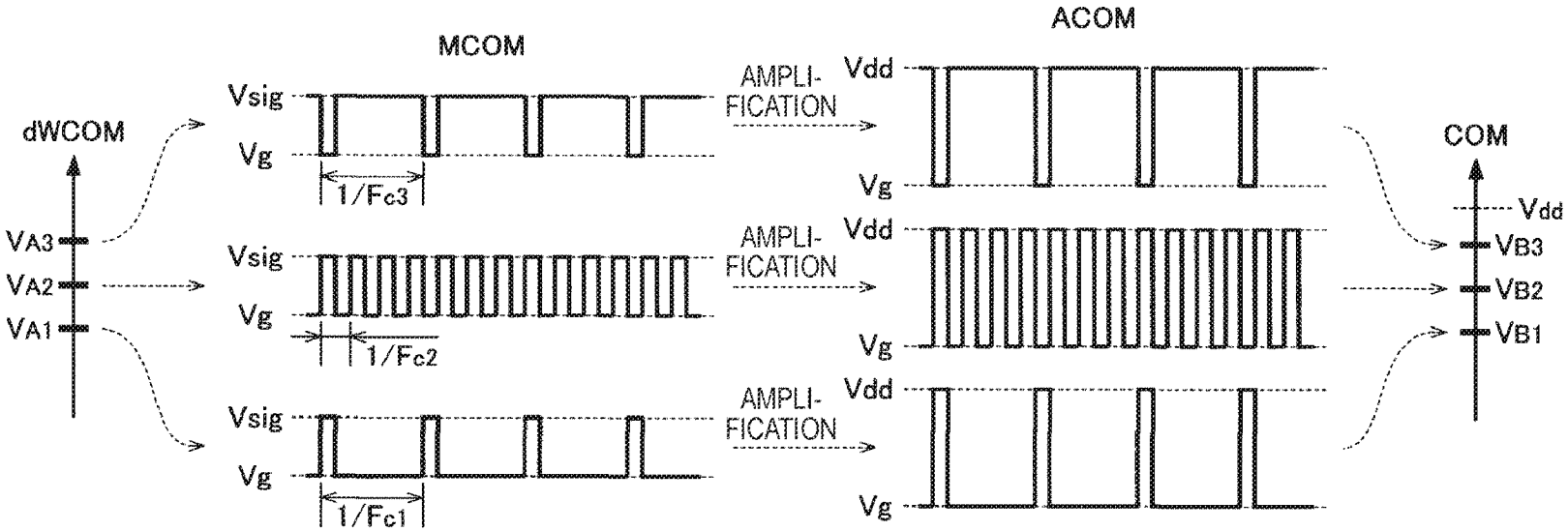
FIG. 7 is an explanatory diagram of a signal generated by each element of the amplifier circuit.

FIG. 7 is an explanatory diagram exemplifying the relationship between the voltage of the difference signal dWCOM, the waveforms of the modulated signal MCOM and the amplified signal ACOM, and the voltage of the drive signal COM. As illustrated in FIG. 7, the modulation circuit 30 generates the modulated signal MCOM having a duty ratio corresponding to the voltage of the difference signal dWCOM. Then, the modulated signal MCOM, which varies between binary values of the reference potential Vg (voltage zero volt) and the voltage Vsig, is amplified to the amplified signal ACOM, which varies between binary values of the reference potential Vg (voltage zero volt) and the power supply voltage Vdd (Vdd>Vsig).

As shown in FIG. 7, an on-duty ratio of the modulated signal MCOM rises as the voltage of the difference signal dWCOM is higher. In FIG. 7, a voltage VA1, a voltage VA2, and a voltage VA3 are exemplified as the voltages of the difference signal dWCOM (VA1<VA2<VA3). The amplified signal ACOM has an on-duty ratio equivalent to that of the modulated signal MCOM. The amplified signal ACOM is smoothed by the smoothing circuit 52 to become the drive signal COM, and as the on-duty ratio of the amplified signal ACOM is higher, the voltage of the drive signal COM becomes higher. Specifically, as illustrated in FIG. 7, if the difference signal dWCOM is the voltage VA2, the drive signal COM is set to a voltage VB2. In addition, If the difference signal dWCOM is the voltage VA1, the drive signal COM of a voltage VB1 lower than the voltage VB2 is generated, and if the difference signal dWCOM is the voltage VA3, the drive signal COM of a voltage VB3 exceeding the voltage VB2 is generated (VB1<VB2<VB3).

As understood from FIG. 7, a pulse modulation frequency (hereinafter, referred to as a "carrier frequency") Fc due to the self-oscillation of the modulation circuit 30 varies according to the voltage of the drive signal COM (or the voltage of the difference signal dWCOM). The carrier frequency Fc is a frequency of the pulse of the modulated signal MCOM or the amplified signal ACOM (the reciprocal of the pulse period). In the example shown in FIG. 7, a carrier frequency Fc2 in a case where the drive signal COM is the voltage VB2 exceeds a carrier frequency Fc1 in a case where the drive signal COM is the voltage VB1 and a carrier frequency Fc3 in a case where the drive signal COM is the voltage VB3. In addition, the carrier frequency Fc1 corresponding to the voltage VB1 is equal to the carrier frequency Fc3 corresponding to the voltage VB3.

FIG. 8 is a graph showing an ideal relationship between the voltage of the drive signal COM and the self-oscillating carrier frequency Fc. Ideally, as illustrated in FIG. 8, the carrier frequency Fc continuously changes with respect to the voltage variation of the drive signal COM. Specifically, the ideal carrier frequency Fc continuously changes from zero to the frequency Fc2 (maximum value) from the reference potential Vg (voltage zero volt) to the voltage VB2 (VB2=Vdd/2, on-duty ratio 50%) and continuously changes from the frequency Fc2 to zero from the voltage VB2 to the power supply voltage Vdd.

However, experiments by the inventor of the present application have confirmed that the relationship between the voltage of the drive signal COM and the carrier frequency Fc can actually be as shown in FIG. 9. As can be seen from FIG. 9, in a case where the voltage of the drive signal COM continuously is changed from the reference potential Vg (voltage zero volt) to the power supply voltage Vdd, within a specific voltage range (hereinafter, referred to as a "frequency lock range") W, even if the voltage of the drive signal COM varies, the carrier frequency Fc does not vary. That is, in the frequency lock range W, the carrier frequency Fc is fixed to a predetermined value Fc_lock. The frequency lock range W is in a range close to each of the reference potential Vg (voltage zero volt) and the power supply voltage Vdd. The frequency lock range W on the reference potential Vg (voltage zero volt) side is in a range from a voltage VX_L to a voltage VX_H (VX_L<VX_H), and the frequency lock range W on the power supply voltage Vdd side is in a range from a voltage VY_L to a voltage VY_H (VY_L<VY_H). However, not all the frequencies within the frequency lock range W are completely consistent with the predetermined value Fc_lock, the fixed frequency may deviate from the predetermined value Fc_lock by about several kHz to about ten kHz depending on conditions such as the magnitude of the voltage value being output within the frequency lock range W.

As exemplified by the solid line in FIG. 10, it is assumed that the drive signal COM periodically varying within a range where a predetermined voltage V2 (hereinafter, referred to as a "base voltage") exceeding the reference potential Vg (voltage zero volt) is a minimum value is generated. That is, the base voltage V2 (an example of a second voltage) is a voltage (offset voltage) serving as a reference of the voltage of the drive signal COM. As understood from FIG. 10, immediately after the generation of the drive signal COM is started, it is necessary to raise the voltage of the drive signal COM from the reference potential Vg (voltage zero volt) to the base voltage V2. Then, in the process of increasing the voltage of the drive signal COM, the voltage of the drive signal COM passes through the frequency lock range W. That is, the carrier frequency Fc is fixed at the predetermined value Fc_lock from the time when the drive signal COM passes the voltage VX_L, and when the drive signal COM reaches the voltage VX_H, the carrier frequency Fc instantaneously rises to a predetermined value Fc_rls in FIG. 9. As described above, the carrier frequency Fc varies discontinuously with respect to the voltage of the drive signal COM, and the actual waveform of the drive signal COM is a waveform which unstably varies at the frequency Fc_lock as shown by the broken line in FIG. 10. As described above, it is presumed that the carrier frequency Fc is fixed to the predetermined value Fc_lock in the frequency lock range W for the following reason.

Figure 11:
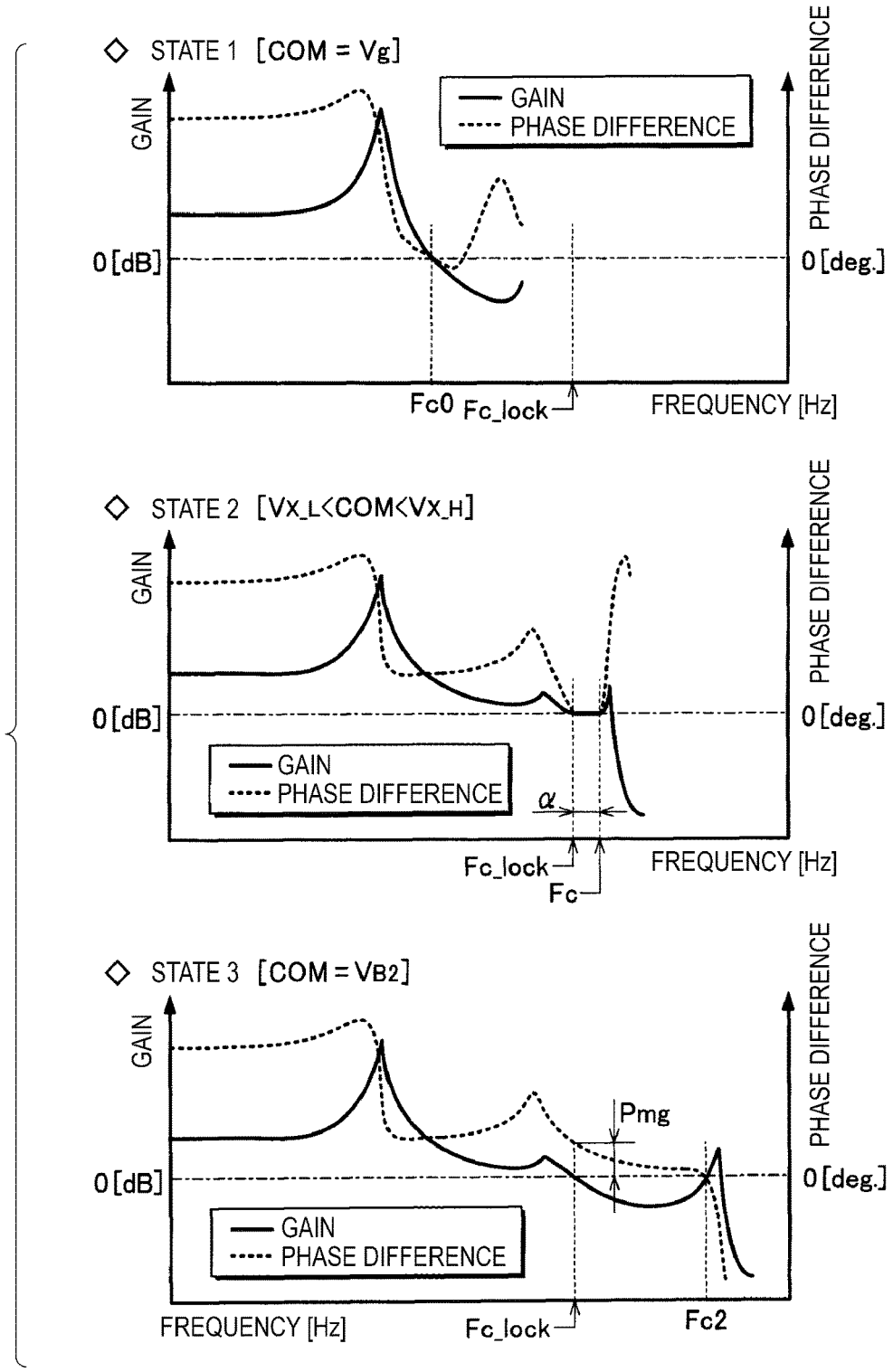
FIG. 11 is an explanatory diagram of a frequency lock range in which the self-oscillating carrier frequency is fixed.

In FIG. 11, loop cycle characteristics of the amplifier circuit 24 are exemplified. There are several measurement methods of loop cycle characteristics, but in the example of FIG. 11, it is assumed that an oscillation condition is a case where the gain is 0 dB and the phase difference is 0 degrees. State 3 in FIG. 11 is a state where the drive signal COM is set to voltage VB2. As illustrated in FIG. 7 and FIG. 8, the carrier frequency Fc due to self-oscillation in a case where the drive signal COM is set to the voltage VB2 is Fc2. From state 3 in FIG. 11, in a case where the drive signal COM is set to the voltage VB2, the gain becomes 0 dB and the phase difference becomes 0 degrees at the frequency Fc2 (carrier frequency), indicating that the oscillation (self-oscillation) is performed at the frequency Fc2. When the drive signal COM is changed from the voltage VB2, the frequency at which the gain is 0 dB and the phase difference is 0 degrees changes to the value of the carrier frequency Fc illustrated in FIG. 8 according to the voltage value of the drive signal COM. As an example, in a case where the drive signal COM is set to voltage VB1, the frequency at which the gain is 0 dB and the phase difference is 0 degrees is Fc1, indicating that the oscillation (self-oscillation) is performed at the frequency Fc1. As illustrated in state 3 in FIG. 11, the gain is 0 dB at the frequency Fc_lock in addition to the frequency Fc2 at which self-oscillation occurs. The frequency Fc_lock at which this gain is 0 dB is a value determined by, for example, the impedance of the amplifier circuit 24, the signal line 16, and the piezoelectric element 116, which is not related to the phenomenon that the gain becomes 0 dB (and the phase difference becomes 0 degrees) at the frequency (carrier frequency) at which self-oscillation occurs as described above. That is, even in a case where the voltage of the drive signal COM is changed, the value of the frequency Fc_lock at which the gain becomes 0 dB does not change. As will be described later, it is important to sufficiently securing a phase margin Pmg (difference from the phase difference 0 degrees) at the frequency Fc_lock at which the gain becomes 0 dB in order to prevent a waveform that unstably varies at the frequency Fc_lock from being generated as illustrated by the broken line in FIG. 10. However, due to various circumstances such as design constraints, the phase margin Pmg may not be sufficiently secured in some cases.

State 1 in FIG. 11 is a state in which the drive signal COM is set to the reference potential Vg (voltage zero volt) immediately after the generation of the drive signal COM is started. In this case, due to a noise component of the drive waveform signal WCOM, the influence of negative feedback control via the compensation circuit 54, or the like the carrier frequency due to self-oscillation is driven not by zero Hz but by a constant carrier frequency Fc0. As the drive signal COM rises from the reference potential Vg (voltage zero volt) in state 1 toward the base voltage V2, the carrier frequency Fc rises. However, in a case where the phase margin Pmg is not sufficiently secured as described above, while the drive signal COM is rising from the reference potential Vg (voltage zero volt) (until the drive signal COM reaches the voltage VX_H after reaching the voltage VX_L), as illustrated in state 2 of FIG. 11, there may be a situation where the gain is 0 dB and the phase difference is 0 degrees over a range $\alpha$ from the predetermined value Fc_lock to the carrier frequency Fc. This is because, as the voltage of the drive signal COM rises, the carrier frequency Fc due to self-oscillation approaches the value of the frequency Fc_lock described above (until the drive signal COM reaches the voltage VX_H after reaching the voltage VX_L), the frequency Fc_lock is a state in which the gain is 0 dB and the phase difference is close to zero degree regardless of the self-oscillating action, and the gain is 0 dB and the phase difference is 0 degrees also at the carrier frequency Fc (value close to the frequency Fc_lock) by the action of the self-oscillation, the gain is 0 dB and the phase difference is 0 degrees over the range α described above. When the frequencies at which the gain is 0 dB and the phase difference is 0 degrees do not intersect at one point and the band has characteristics of the range α as described above, self-oscillation tends to occur at lower frequencies in the band. That is, since the drive signal COM has the band (range α) as described above, while being form the voltage VX_L to the voltage VX_H, a phenomenon occurs in which the carrier frequency Fc is fixed to Fc_lock, which is the lower frequency side of the band (range α).

As detailed above, as the carrier frequency Fc is fixed to the predetermined value Fc_lock in the process of changing the drive signal COM from the reference potential Vg (voltage zero volt) to the base voltage V2, as illustrated in FIG. 10 (broken line), there is a problem that the voltage of the drive signal COM can vary unstably. The waveform example shown by the broken line in FIG. 10 shows a case where the unstable state that oscillation is performed at the frequency Fc_lock continues for a predetermined time even if the voltage of the drive signal COM is higher than VX_H. This is because the oscillation of the frequency Fc_lock cannot be instantaneously stopped even if the condition that the carrier frequency Fc is fixed to the predetermined value Fc_lock is canceled. The time for which this unstable state continues varies depending on conditions such as the waveform shape of the drive signal COM and the rise speed of the voltage. From the viewpoint of solving the above problem, in the first embodiment, in the process of changing the drive signal COM from the reference potential Vg (voltage zero volt) to the base voltage V2, a predetermined voltage (hereinafter, referred to as an "initial voltage") V1 is supplied to the piezoelectric element 116 as the drive signal COM. The initial voltage V1 is a voltage generated independently of the operation (that is, self-oscillation) of the modulation circuit 30 and the digital power amplifier circuit 40. Then, at the stage when the voltage of the drive signal COM reaches the initial voltage V1, which is a voltage outside the frequency lock range W (between the voltage VX_L and the voltage VX_H), generation of the drive signal COM using self-oscillation is started.

The voltage generating circuit 60 in FIG. 2 generates the initial voltage V1 (an example of a first voltage). The initial voltage V1 is a voltage that exceeds the frequency lock range W (that is, voltage range in which the carrier frequency Fc by self-oscillation is fixed to a predetermined value Fc_lock with respect to the voltage variation of the drive signal COM). Specifically, the initial voltage V1 exceeds the upper limit voltage VX_H of the frequency lock range W. In the first embodiment, a case where the voltage generating circuit 60 generates the initial voltage V1 equivalent to the base voltage V2 is illustrated.

Figure 12:
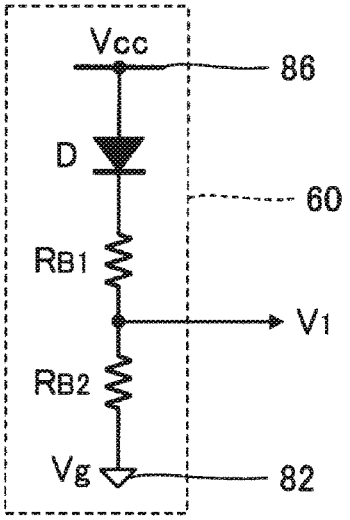
FIG. 12 is a configuration diagram of a voltage generating circuit.

FIG. 12 is a configuration diagram of the voltage generating circuit 60. As illustrated in FIG. 12, the voltage generating circuit 60 of the first embodiment is configured to include a resistance element RB1 and a resistance element RB2, and a diode D which is an example of a backflow preventing element. The diode D is connected between a voltage line 86 to which a predetermined voltage Vcc (Vcc>V1) is supplied and the resistance element RB1, and the resistance element RB2 is connected between the resistance element RB1 and the reference line 82. The initial voltage V1 is generated by dividing the voltage Vcc using the resistance element RB1 and the resistance element RB2. In addition, a reverse flow of the current from the output point N of the digital power amplifier circuit 40 to the voltage line 86 via the resistance element RB1 is blocked by the diode D. If it is not necessary to raise the value of the initial voltage V1 in a short time, it is also possible to omit the resistance element RB2.

Figure 13:
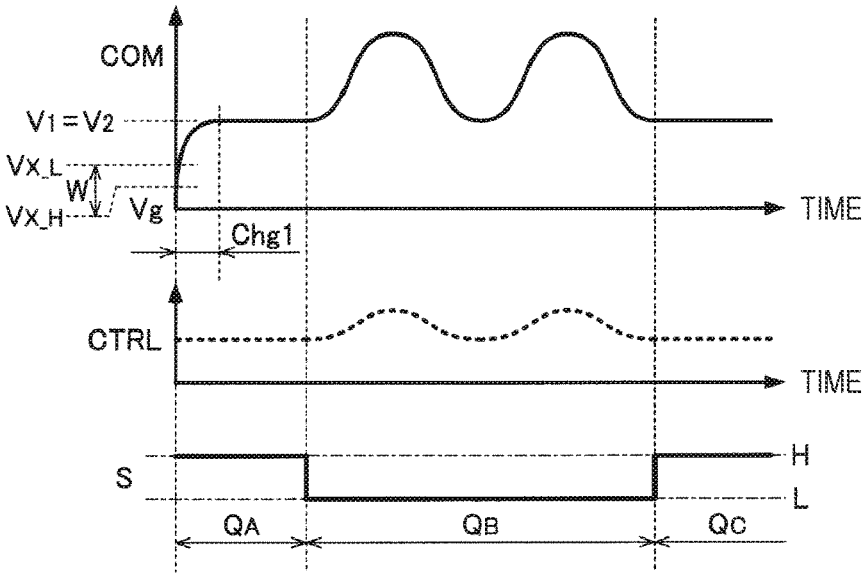
FIG. 13 is an explanatory diagram of an operation of the amplifier circuit.

FIG. 13 is an explanatory diagram of an operation of the amplifier circuit 24. As illustrated in FIG. 13, the operation of the amplifier circuit 24 of the first embodiment is divided into a preparation period QA, an operation period QB, and a stop period QC. The preparation period QA is an initial period in which the drive signal COM is set to the initial voltage V1 generated by the voltage generating circuit 60 immediately after the operation of the amplifier circuit 24 is started. In the preparation period QA, the control circuit 26 supplies the waveform indication data CTRL instructing the generation of the drive waveform signal WCOM where the drive signal COM becomes the base voltage V2 to the signal generating circuit 22, and the signal generating circuit 22 generates the drive waveform signal WCOM according to the waveform indication data CTRL. In addition, in the preparation period QA, as illustrated in FIG. 13, the control circuit 26 sets the control signal S to a high level so that the digital power amplifier circuit 40 is in a stopped state (both the first transistor T1 and the second transistor T2 illustrated in FIG. 5 are in an OFF state). Therefore, the drive waveform signal WCOM generated by the signal generating circuit 22 is not reflected in the drive signal COM in the preparation period QA, the initial voltage V1 generated by the voltage generating circuit 60 is supplied to the piezoelectric element 116 via the smoothing circuit 52 as the drive signal COM. When the piezoelectric element 116 is charged due to the supply of the initial voltage V1 and a predetermined time (hereinafter, referred to as a "charging period") Chg1 elapses from the start of the preparation period QA, the drive signal COM is set to the initial voltage V1 (=V2).

When the charging period Chg1 has elapsed, the preparation period QA shifts to the operation period QB with the instruction of the operation start from the user as a trigger. When the operation period QB is started, the control circuit 26 changes the control signal S from a high level to a low level and supplies the waveform indication data CTRL to the signal generating circuit 22, which instructs the drive waveform signal WCOM to periodically vary. Due to the change of the control signal S, the digital power amplifier circuit 40 transitions to the operation state. In addition, the modulated signal MCOM corresponding to the drive waveform signal WCOM generated by the signal generating circuit 22 is supplied from the modulation circuit 30 to the digital power amplifier circuit 40. Therefore, as illustrated in FIG. 13, in the operation period QB, by the switching operation of the first transistor T1 and the second transistor T2 according to the modulated signal MCOM, the drive signal COM having the waveform corresponding to the drive waveform signal WCOM is generated. As described above, after the signal generating circuit 22 generates the drive waveform signal WCOM where the drive signal COM becomes the base voltage V2 and the drive signal COM is set to the initial voltage V1, the control circuit 26 starts the operation of the digital power amplifier circuit 40. That is, the drive signal COM is set to the initial voltage V1 in the preparation period QA and periodically varies according to the drive waveform signal WCOM in the operation period QB. The drive signal COM is a signal output from the amplifier circuit 24 and supplied to the piezoelectric element 116.

In the operation period QB exemplified above, liquid is ejected from the nozzle 114 by supplying the drive signal COM to the piezoelectric element 116 of the liquid ejection unit 11. When the operation stop (stopping the generation of the drive signal COM) is instructed from the user in the operation period QB, the operation period QB shifts to the stop period QC. When the stop period QC is started, the control circuit 26 changes the control signal S from a low level to a high level while supplies the waveform indication data CTRL to the signal generating circuit 22 instructing the drive waveform signal WCOM where the drive signal COM becomes the base voltage V2. As the control signal S changes, the digital power amplifier circuit 40 transitions to the stop state, similarly to the preparation period QA, in the stop period QC, so the initial voltage V1 generated by the voltage generating circuit 60 is supplied to the piezoelectric element 116 as the drive signal COM. As understood from the above description, when the stop of generation of the drive signal COM is instructed, while the operation of the digital power amplifier circuit 40 stops, the signal generating circuit 22 continues to generate the drive waveform signal WCOM where the drive signal COM becomes the base voltage V2. Therefore, it is possible to restart the generation of the drive signal COM without passing through the frequency lock range W. That is, for example, when an instruction to resume operation is given from the user in the stop period QC, the stop period QC shifts to the operation period QB, and the generation of the drive signal COM is restarted.

Figure 14:
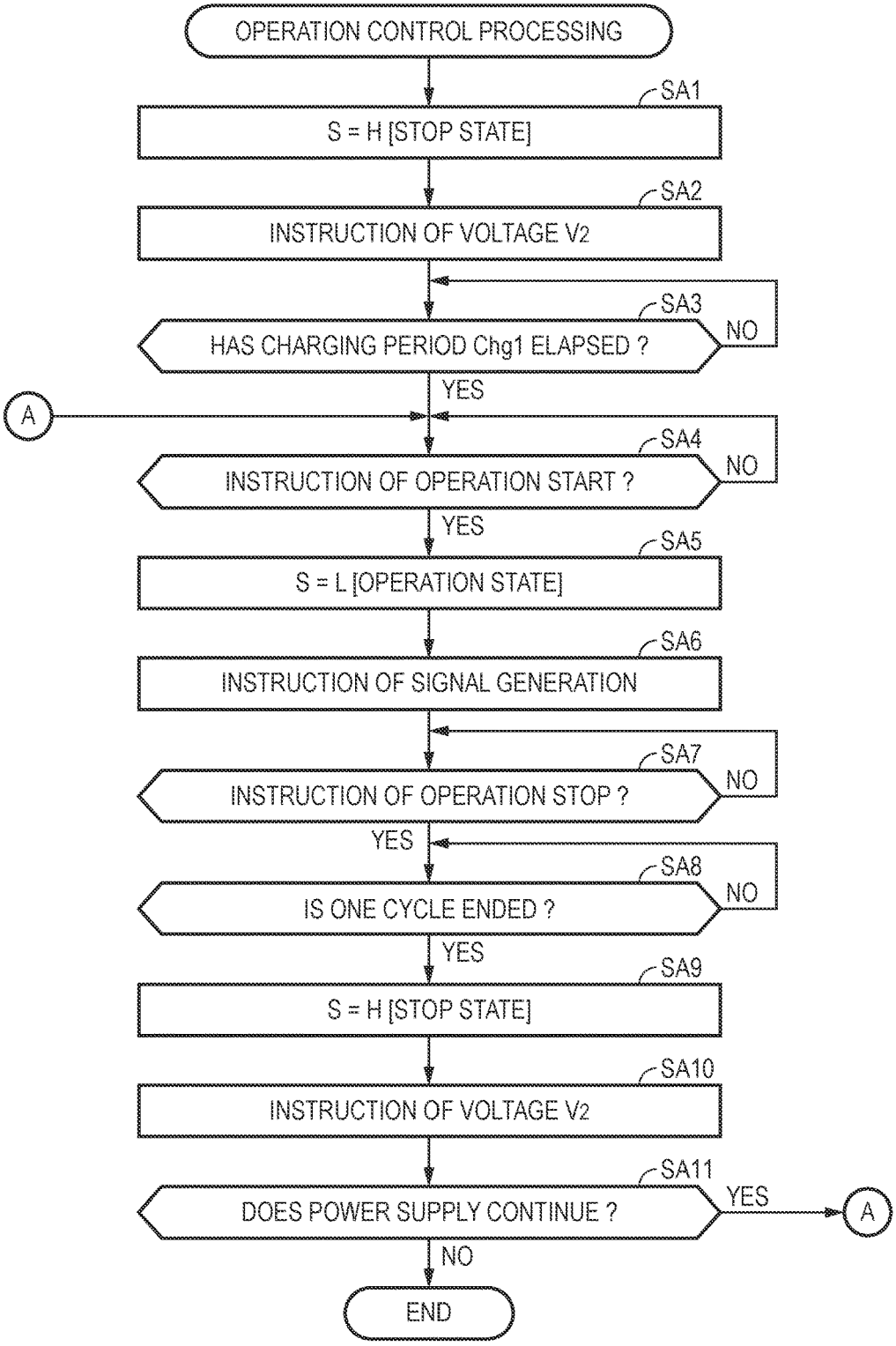
FIG. 14 is a flowchart of an operation of a control circuit.

FIG. 14 is a flowchart of processing (hereinafter, referred to as "operation control processing") for controlling the amplifier circuit 24 by the control circuit 26. When the liquid ejection device 100A is powered on, the operation control processing of FIG. 14 is started. When the operation control processing is started, the control circuit 26 controls the digital power amplifier circuit 40 to be in the stop state by setting the control signal S to a high level (SA1) and instructs the signal generating circuit 22 to generate the drive waveform signal WCOM where the drive signal COM becomes the base voltage V2 (SA2). Therefore, the initial voltage V1 generated by the voltage generating circuit 60 is supplied to the piezoelectric element 116 as the drive signal COM.

The control circuit 26 waits until the charging period Chg1 elapses (SA3: NO). When the charging period Chg1 has elapsed (SA3: YES), the control circuit 26 waits for an instruction to start the operation by the user (SA4: NO). Upon detecting an instruction to start operation, the control circuit 26 controls the digital power amplifier circuit 40 to be in the operation state by changing the control signal S from the high level to the low level (SA5). In addition, the control circuit 26 instructs the signal generating circuit 22 to generate the drive waveform signal WCOM which periodically varies (SA6). Therefore, the drive signal COM which periodically varies in a range equal to or higher than the base voltage V2 is supplied to the piezoelectric element 116 from the amplifier circuit 24. Generation of the drive signal COM described above continues until the user instructs to stop the operation.

Upon receipt of an operation stop instruction (SA7: YES), the control circuit 26 waits until an end point of one cycle of the drive signal COM is reached (SA8: NO). When the endpoint of one cycle of the drive signal COM is reached (SA8: YES), the control circuit 26 controls the digital power amplifier circuit 40 to be in the stop state by changing the control signal S from the low level to the high level (SA9). In addition, the control circuit 26 instructs the signal generating circuit 22 to generate the drive waveform signal WCOM where the drive signal COM becomes the base voltage V2 (SA10). Then, the control circuit 26 determines whether or not power supply to the amplifier circuit 24 continues (SA11). In a case where the power supply continues (SA11: YES), the control circuit 26 shifts the processing to Step SA4 and waits for an instruction to start the operation. On the other hand, for example, when the power supply is cut off in response to the instruction from the user (SA11: NO), the control circuit 26 ends the operation control processing of FIG. 14.

As described above, in the first embodiment, after the signal generating circuit 22 generates the drive waveform signal WCOM where the drive signal COM becomes the base voltage V2 and the drive signal COM is set to the initial voltage V1, the operation of the digital power amplifier circuit 40 is started. Therefore, it is possible to suppress the voltage variation of the drive signal COM caused by the self-oscillation as compared with the configuration in which the digital power amplifier circuit 40 is operated from the start of generation of the drive signal COM.

Second Embodiment

A second embodiment of the invention will be described. For the elements having the same operations or functions as those of the first embodiment in the following examples, the reference numerals used in the description of the first embodiment are used, and the detailed description thereof will be appropriately omitted.

Figure 15:
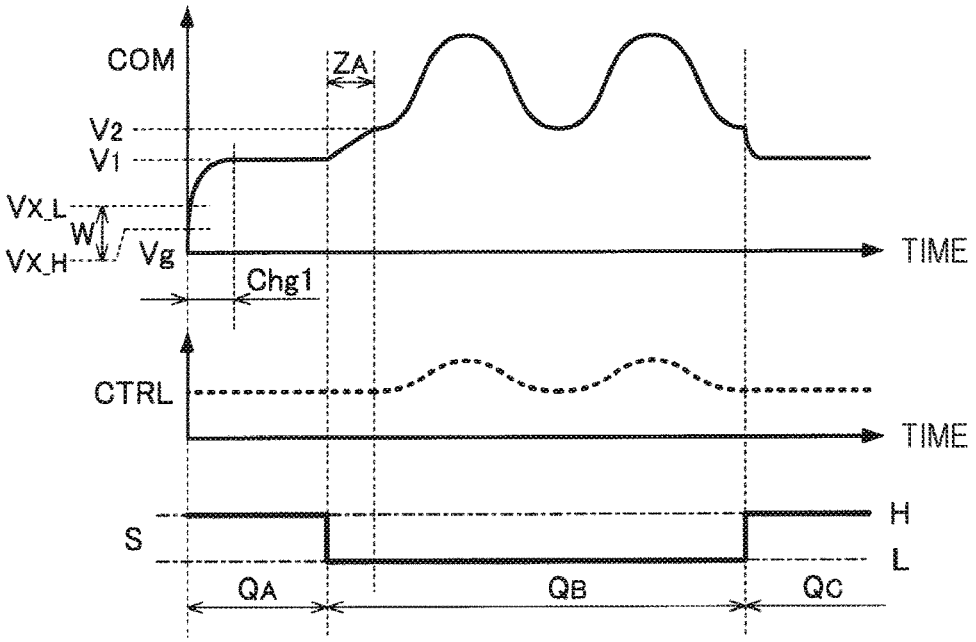
FIG. 15 is an explanatory diagram of an operation of an amplifier circuit in a second embodiment.

FIG. 15 is an explanatory diagram of an operation of the amplifier circuit 24 in the second embodiment. In the first embodiment, the case where the initial voltage V1 generated by the voltage generating circuit 60 is equal to the base voltage V2 which is the minimum value of the voltage of the drive signal COM is exemplified. As illustrated in FIG. 15, in the second embodiment, the base voltage V2 exceeds the initial voltage V1. Specifically, in the preparation period QA, the drive signal COM is set to the initial voltage V1 as in the first embodiment, and generation of the drive waveform signal WCOM corresponding to the drive signal COM of the base voltage V2 exceeding the initial voltage V1 is instructed to the signal generating circuit 22. When the preparation period QA has elapsed and the operation period QB is started, the voltage of the drive signal COM varies from the initial voltage V1 to the base voltage V2 within a period ZA (hereinafter, referred to as a "variation period") extending from the start point of the operation period QB by a predetermined length. The subsequent operations are the same as in the first embodiment.

Figure 16:
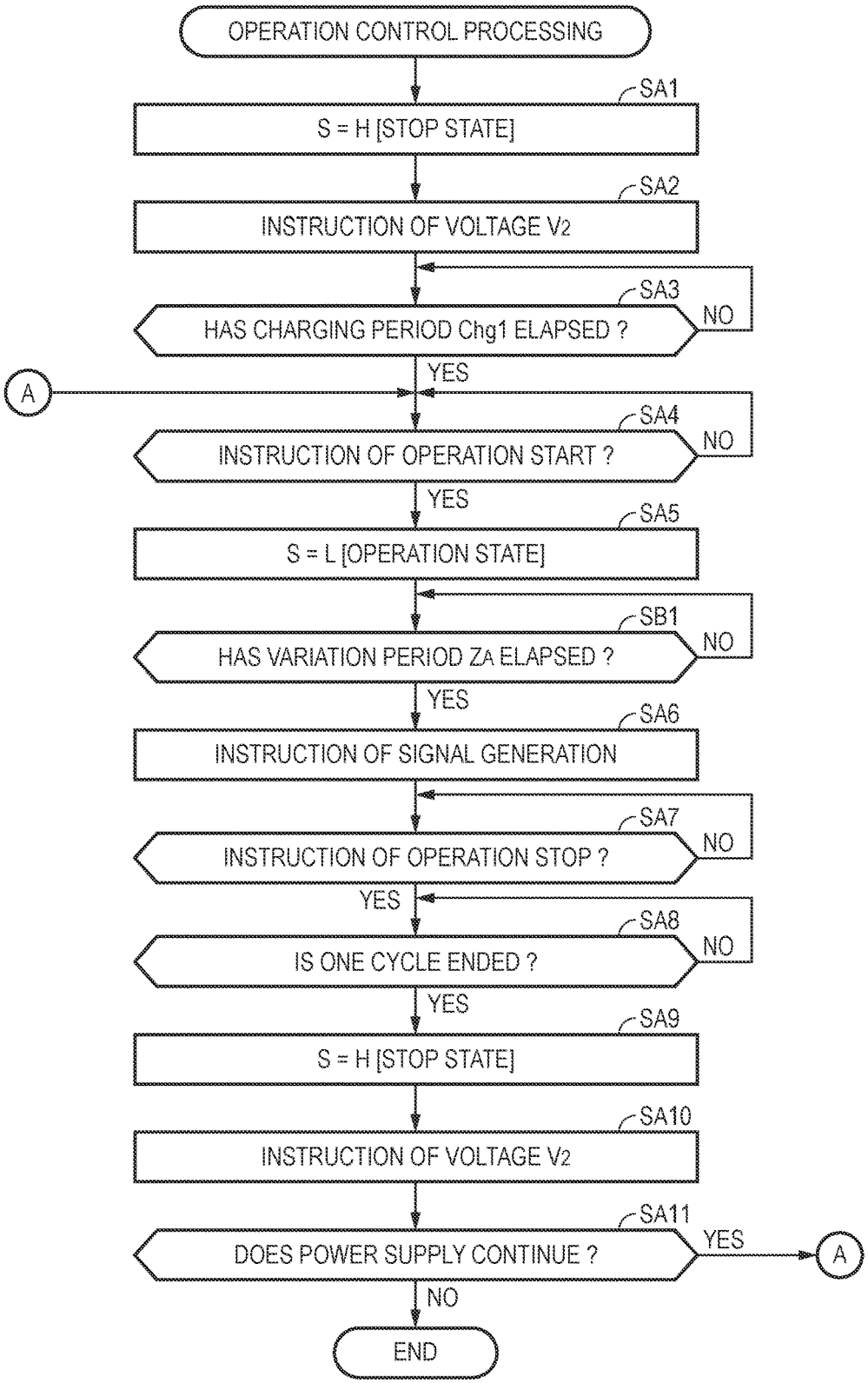
FIG. 16 is a flowchart of operation control processing in the second embodiment.

FIG. 16 is a flowchart of the operation control processing executed by the control circuit 26 of the second embodiment. As illustrated in FIG. 16, the operation control processing according to the second embodiment has a content in which Step SB1 is added to the operation control processing of the first embodiment illustrated in FIG. 14. Specifically, when the digital power amplifier circuit 40 is controlled to be in the operation state by setting the control signal S to the low level (SA5), the control circuit 26 waits until the variation period ZA elapses (SB1: NO). The variation period ZA is set to a length of time sufficient for the drive signal COM to change from the initial voltage V1 to the base voltage V2. When the variation period ZA has elapsed (SB1: YES), the control circuit 26 instructs the signal generating circuit 22 to generate the drive waveform signal WCOM which periodically varies (SA6).

The other configuration or operation in the second embodiment is the same as in the first embodiment. Therefore, the same effects as in the first embodiment are realized also in the second embodiment. As understood from the above description, the first embodiment and the second embodiment are generally expressed as a configuration in which the base voltage V2 is set to a voltage equal to or higher than the initial voltage V1.

Third Embodiment

Figure 17:
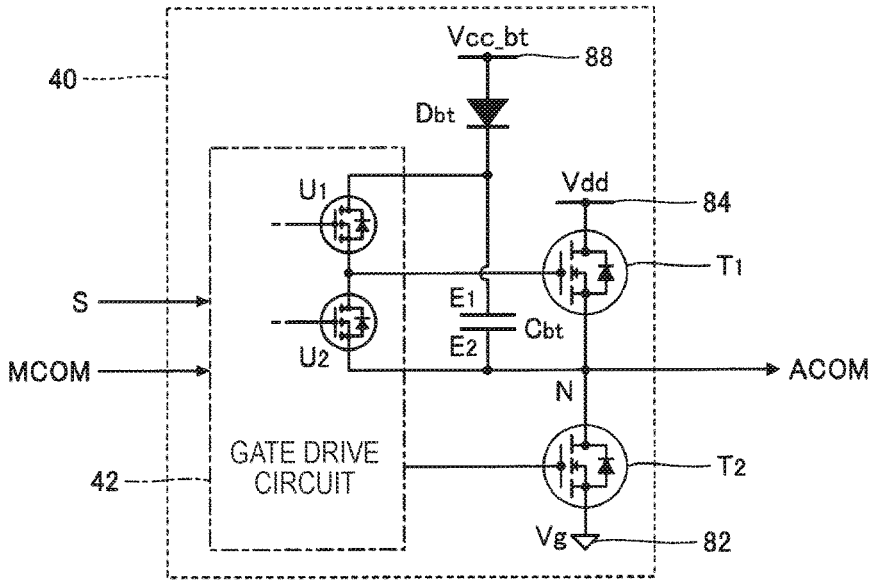
FIG. 17 is a configuration diagram of a digital power amplifier circuit in a third embodiment.

FIG. 17 is a configuration diagram of the digital power amplifier circuit 40 in a third embodiment. As illustrated in FIG. 17, the digital power amplifier circuit 40 of the third embodiment has a configuration in which a capacitive element Cbt and a diode Dbt are added to the same elements as those in the first embodiment (FIG. 5). The capacitive element Cbt and the diode Dbt apply a voltage exceeding a threshold voltage between the gate and the source of the first transistor T1 using the gate drive circuit 42 so that the digital power amplifier circuit 40 functions as a bootstrap circuit capable of controlling the first transistor T1 to be in an ON state when the operation of the amplifier circuit 24 is started.

The capacitive element Cbt is an electrostatic capacitance including an electrode E1 and an electrode E2 and is installed between the gate and the source of the first transistor T1 via a transistor U1. The diode Dbt is disposed between a voltage line 88 to which a predetermined voltage Vcc_bt is supplied and the capacitive element Cbt. Specifically, the electrode E1 of the capacitive element Cbt is connected to the cathode of the diode Dbt and the electrode E2 is connected to the source of the first transistor T1.

As illustrated in FIG. 17, at the output stage of the gate drive circuit 42, the transistor U1 and a transistor U2 are installed. The transistor U1 is interposed between the gate of the first transistor T1 and the electrode E1 of the capacitive element Cbt to control the conduction therebetween. The transistor U2 is interposed between the gate of the first transistor T1 and the electrode E2 (the source of the first transistor T1) of the capacitive element Cbt to control conduction therebetween.

In the above configuration, when the second transistor T2 transitions to an ON state, the potential of the electrode E2 of the capacitive element Cbt becomes the reference potential Vg via the second transistor T2. Therefore, between the electrodes E1 and E2 of the capacitive element Cbt, the voltage Vcc_bt (voltage which is actually lower than the voltage Vcc_bt by a forward voltage of the diode Dbt) is applied via the diode Dbt. That is, the capacitive element Cbt is charged by the voltage Vcc_bt. In the above state, when the transistor U1 of the gate drive circuit 42 transitions to an ON state after the second transistor T2 transitions to an OFF state, the voltage Vcc_bt between both terminals of the capacitive element Cbt is applied between the gate and the source of the first transistor T1. Therefore, the first transistor T1 transitions to an ON state.

Figure 18:
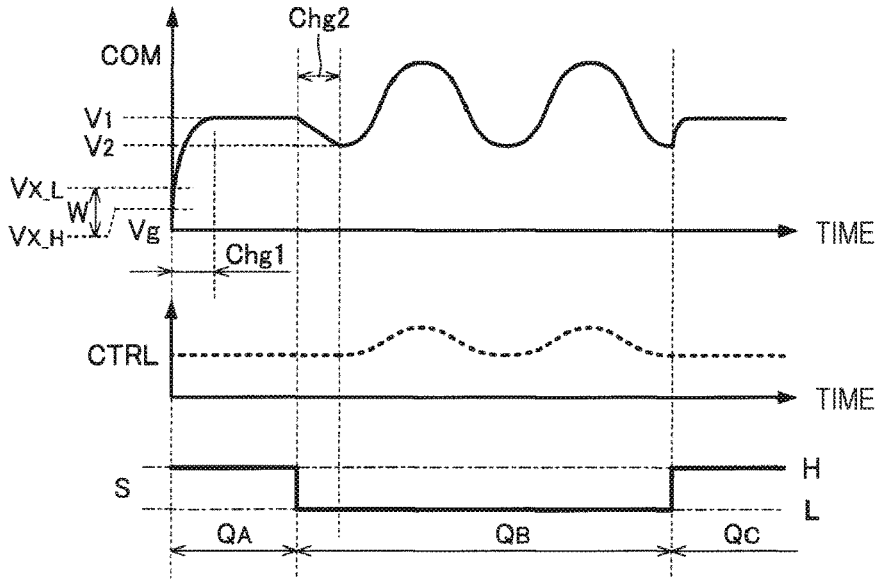
FIG. 18 is an explanatory diagram of an operation of the amplifier circuit in the third embodiment.

FIG. 18 is an explanatory diagram of an operation of the amplifier circuit 24 in the third embodiment. In the configuration in which the base voltage V2 exceeds the initial voltage V1 as in the second embodiment, from the state that the drive signal COM is set to the initial voltage V1 in the preparation period QA, the capacitive element Cbt cannot be charged. Therefore, in the third embodiment, as illustrated in FIG. 18, the base voltage V2 which is the minimum value of the voltage of the drive signal COM is set to a voltage lower than the initial voltage V1 generated by the voltage generating circuit 60 (V2<V1). Specifically, the capacitive element Cbt is charged in a first period (hereinafter, referred to as a "charging period") Chg2 of the operation period QB. That is, in the charging period Chg2, the capacitive element Cbt is charged by controlling the second transistor T2 to be in an ON state, and the drive signal COM drops from the initial voltage V1 to the base voltage V2. Therefore, the first transistor T1 is in a state in which the first transistor T1 can transition to an ON state.

Figure 19:
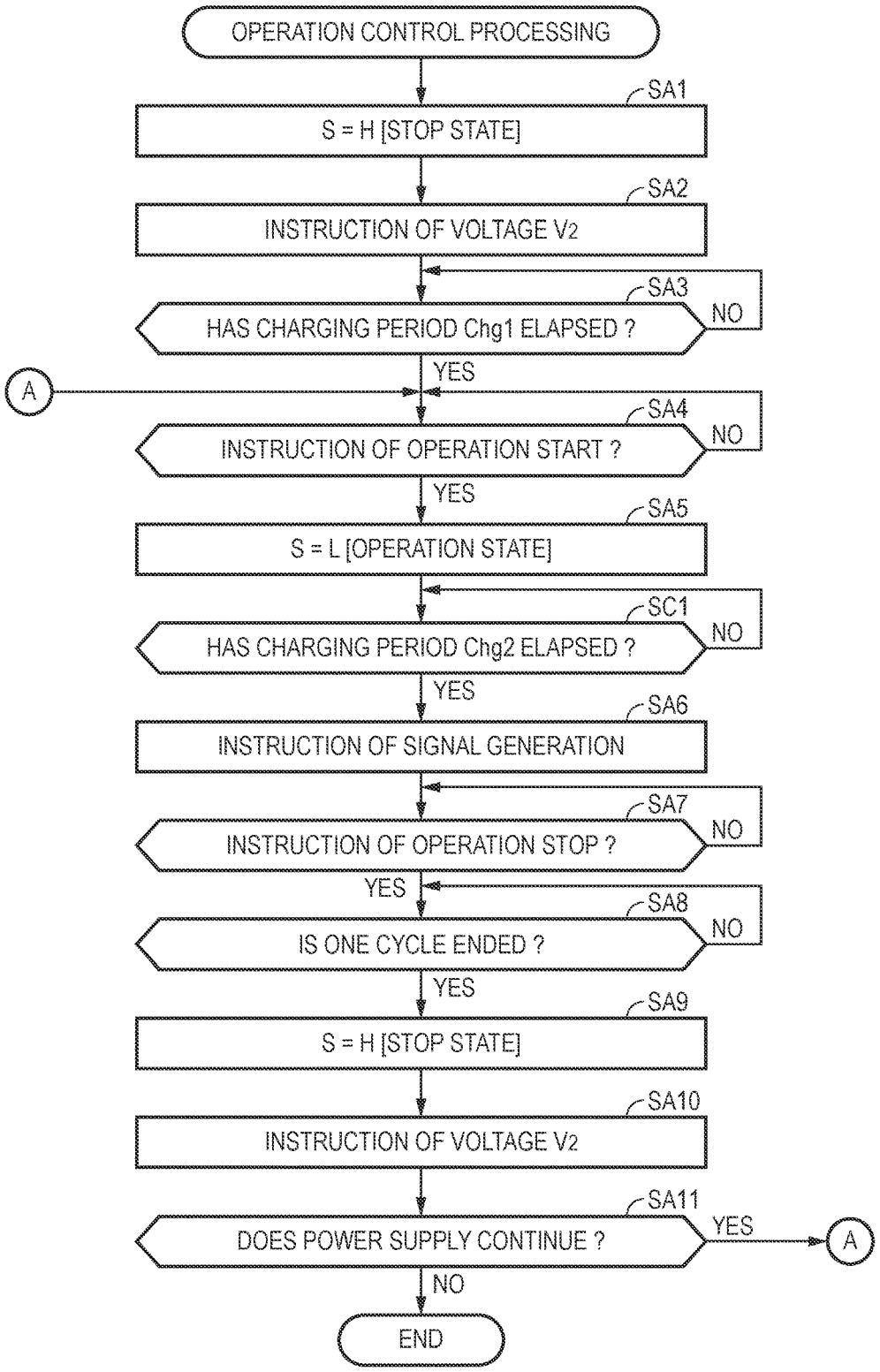
FIG. 19 is a flowchart of operation control processing in the third embodiment.

FIG. 19 is a flowchart of the operation control processing executed by the control circuit 26 of the third embodiment. As illustrated in FIG. 19, the operation control processing according to the third embodiment has a content in which Step SC1 is added to the operation control processing of the first embodiment illustrated in FIG. 14. Specifically, when the digital power amplifier circuit 40 is controlled to be in the operation state by setting the control signal S to the low level (SA5), the control circuit 26 waits until the charging period Chg2 elapses (SC1: NO). When the charging period Chg2 has elapsed (SC1: YES), the control circuit 26 instructs the signal generating circuit 22 to generate the drive waveform signal WCOM which periodically varies (SA6).

The other configuration or operation in the third embodiment is the same as in the first embodiment. Therefore, the same effects as in the first embodiment are realized also in the third embodiment. In addition, since the base voltage V2 is lower than the initial voltage V1 in the third embodiment, there is an advantage that the capacitive element Cbt for controlling the first transistor T1 to be in an ON state can be appropriately charged.

Fourth Embodiment

A fourth embodiment of the invention will be described. As in the third embodiment, the digital power amplifier circuit 40 of the fourth embodiment includes the capacitive element Cbt provided between the gate and the source of the first transistor T1 via the transistor U1, and the diode Dbt connected to the electrode E1 of the capacitive element Cbt. That is, a bootstrap circuit for controlling the first transistor T1 to be in an ON state is configured when the operation of the amplifier circuit 24 is started.

Figure 20:
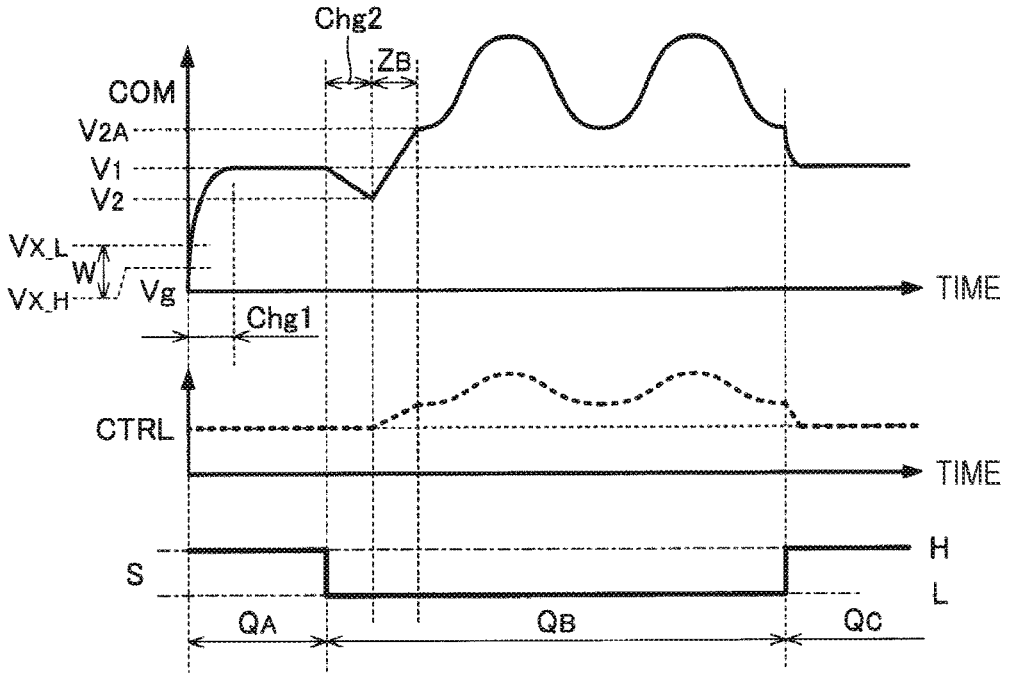
FIG. 20 is an explanatory diagram of an operation of an amplifier circuit in a fourth embodiment.

FIG. 20 is an explanatory diagram of an operation of the amplifier circuit 24 in the fourth embodiment. As illustrated in FIG. 20, the operation period QB of the fourth embodiment includes the charging period Chg2 and a variation period ZB. As in the third embodiment, the charging period Chg2 is a period for charging the capacitive element Cbt to control the first transistor T1 to be in an ON state. That is, in the charging period Chg2, the capacitive element Cbt is charged by controlling the second transistor T2 to be in an ON state, and the drive signal COM changes from the initial voltage V1 to the base voltage V2 (V2<V1).

The variation period ZB is a period in which the drive signal COM set at the base voltage V2 in the charging period Chg2 is changed to a second base voltage V2A. Like the base voltage V2 in the first embodiment to the third embodiment, the second base voltage V2A is a voltage (offset voltage) serving as a reference of the voltage of the drive signal COM. That is, in the fourth embodiment, the voltage of the drive signal COM varies periodically within a range in which the second base voltage V2A is a minimum value. As illustrated in FIG. 20, the second base voltage V2A exceeds the initial voltage V1 and the base voltage V2. That is, in the fourth embodiment, the capacitive element Cbt is charged by lowering the voltage of the drive signal COM from the initial voltage V1 to the base voltage V2 within the charging period Chg2, and then the voltage of the drive signal COM is raised from the base voltage V2 to the second base voltage V2A.

Figure 21:
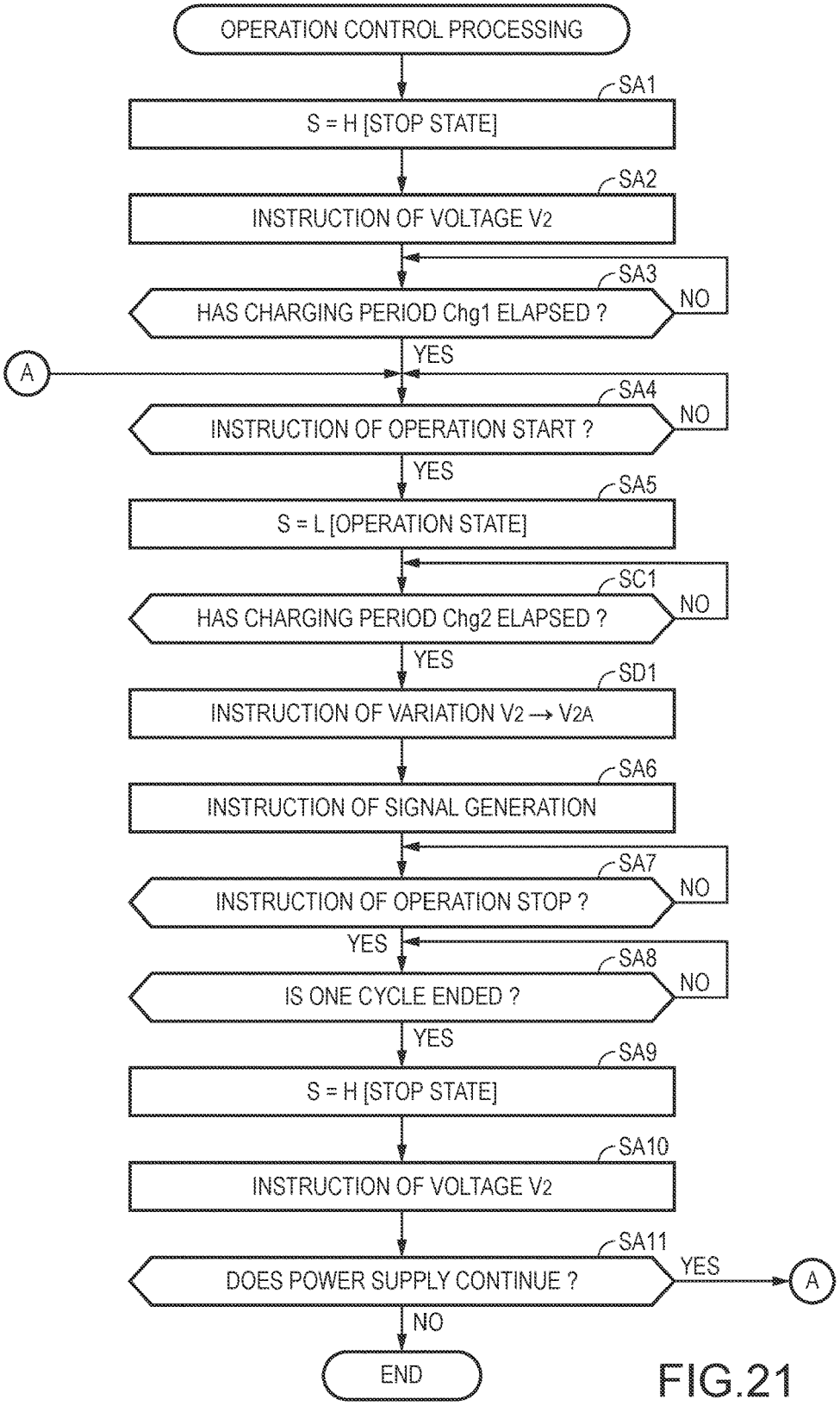
FIG. 21 is a flowchart of operation control processing in the fourth embodiment.

FIG. 21 is a flowchart of the operation control processing executed by the control circuit 26 of the fourth embodiment.

As illustrated in FIG. 21, the operation control processing according to the fourth embodiment has a content in which Step SD1 is added to the operation control processing of the third embodiment illustrated in FIG. 19. Specifically, when the charging period Chg2 has elapsed (SC1: YES), the control circuit 26 supplies the waveform indication data CTRL to the signal generating circuit 22 to vary the drive signal COM from the base voltage V2 to the second base voltage V2A (SD1). In response to the instruction from the control circuit 26, the signal generating circuit 22 generates the drive waveform signal WCOM such that the drive signal COM varies from the base voltage V2 to the second base voltage V2A in the variation period ZB. When the variation period ZB has elapsed, the control circuit 26 instructs the signal generating circuit to generate the drive waveform signal WCOM which periodically varies (SA6).

Also in the fourth embodiment, effects similar to those of the first embodiment and the third embodiment are realized. In addition, in the fourth embodiment, the capacitive element Cbt is charged by lowering the voltage of the drive signal COM from the initial voltage V1 to the base voltage V2, and then the voltage of the drive signal COM is raised to the second base voltage V2A. Therefore, it is possible to generate the drive signal COM which varies with reference to the second base voltage V2A which is different from the base voltage V2 necessary for charging the capacitive element Cbt.

Fifth Embodiment

Figure 22:
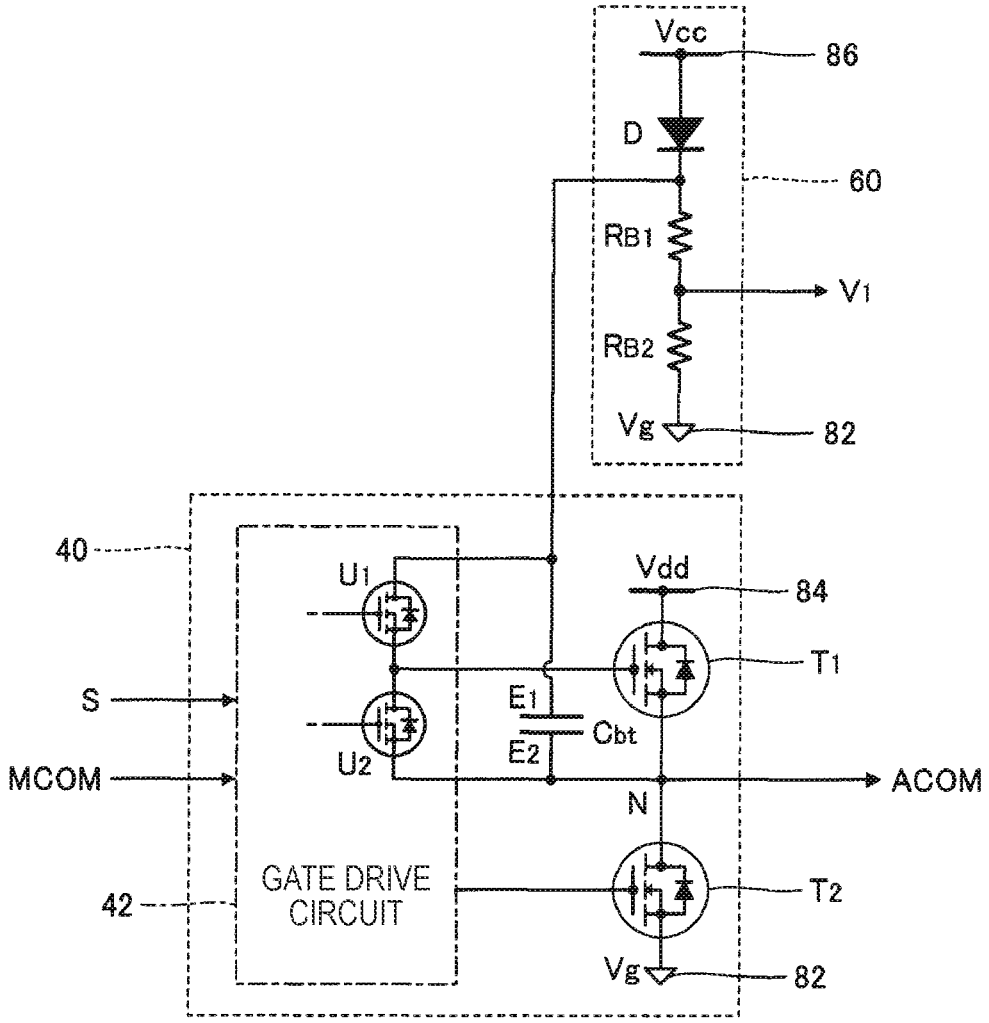
FIG. 22 is a configuration diagram of a digital power amplifier circuit and a voltage generating circuit of a fifth embodiment.

FIG. 22 is a configuration diagram of the digital power amplifier circuit 40 and the voltage generating circuit 60 in a fifth embodiment. As illustrated in FIG. 22, the configuration of the voltage generating circuit 60 of the fifth embodiment is the same as that of the first embodiment. That is, the voltage generating circuit 60 has a configuration in which the diode D, the resistance element RB1, and the resistance element RB2 are connected in series between the voltage line 86 of the voltage Vcc and the reference line 82 of the reference potential Vg. In addition, as in the third embodiment, the digital power amplifier circuit 40 of the fifth embodiment includes the capacitive element Cbt (bootstrap circuit) installed between the gate and the source of the first transistor T1.

The electrode E1 of the capacitive element Cbt is connected between the diode D of the voltage generating circuit 60 and the resistance element RB1. That is, when the second transistor T2 transitions to an ON state, the voltage Vcc of the voltage line 86 is applied between the electrodes E1 and E2 via the diode D, whereby the capacitive element Cbt is charged. As understood from the above description, in the fifth embodiment, the diode D and the voltage Vcc for generating the initial voltage V1 by the voltage generating circuit 60 are also used as a bootstrap circuit for setting the first transistor T1 to be in an ON state.

Also in the fifth embodiment, the same effects as in the first embodiment are realized. In addition, in the fifth embodiment, the voltage Vcc used by the voltage generating circuit 60 to generate the initial voltage V1 is also used to charge the capacitive element Cbt. Therefore, there is an advantage that the configuration of the drive circuit 200 is simplified as compared with a configuration using separate voltages for generation of the initial voltage V1 and charging of the capacitive element Cbt. The configuration of the fifth embodiment is applied not only to the third embodiment but also to the fourth embodiment similarly.

Sixth Embodiment

Figure 23:
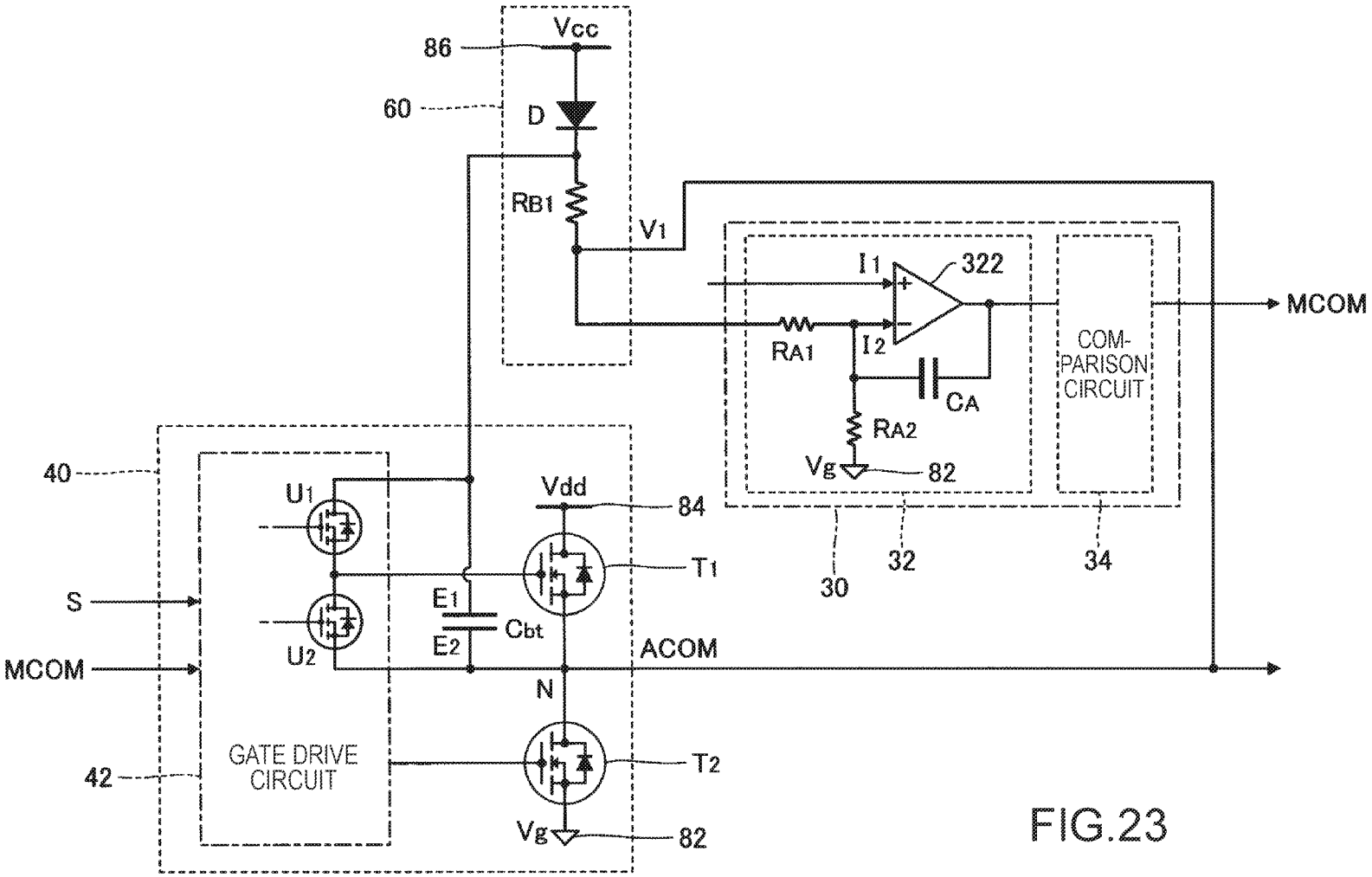
FIG. 23 is a configuration diagram of a voltage generating circuit and a modulation circuit in a sixth embodiment.

FIG. 23 is a configuration diagram of the modulation circuit 30, the voltage generating circuit 60, and the digital power amplifier circuit 40 in a sixth embodiment. As illustrated in FIG. 23, in the sixth embodiment, as in the fifth embodiment, the diode D and the voltage Vcc for generating the initial voltage V1 by the voltage generating circuit 60 are also used for charging the capacitive element Cbt. In addition, in the sixth embodiment, the resistance element RA1 and the resistance element RA2 constituting the integration circuit 32 of the modulation circuit 30 are also used for generation of the initial voltage V1 by the voltage generating circuit 60. Specifically, the terminal on the opposite side of the voltage line 86 of the resistance element RB1 of the voltage generating circuit 60 is connected to a terminal on the opposite side of the resistance element RA1 from the minus side input terminal I2 of the arithmetic amplifier 322 of the integration circuit 32. That is, the resistance element RA1 and the resistance element RA2 connected to the minus side input terminal I2 are used for the integration circuit 32 and are also used for voltage division for generating the initial voltage V1 from the voltage Vcc by the voltage generating circuit 60.

Also in the sixth embodiment, the same effects as in the first embodiment are realized. In addition, in the sixth embodiment, the resistance element RA1 and the resistance element RA2 constituting the integration circuit 32 of the modulation circuit 30 are also used for generation of the initial voltage V1 by the voltage generating circuit 60. Therefore, there is an advantage that the configuration of the drive circuit 200 is simplified as compared with a configuration using a resistance element (for example, the resistance element RB2 of the first embodiment) separate from the resistance element RA1 and the resistance element RA2 for generation of the initial voltage V1. The configuration of the sixth embodiment is applied not only to the third embodiment but also to the fourth embodiment similarly. In addition, the configuration of the fifth embodiment in which the diode D and the voltage Vcc are used for charging the capacitive element Cbt can be omitted in the sixth embodiment.

Modification Example

Each embodiment exemplified above can be variously modified. Two or more embodiments arbitrarily selected from the above embodiments and the following examples can be appropriately combined.

Figure 24:
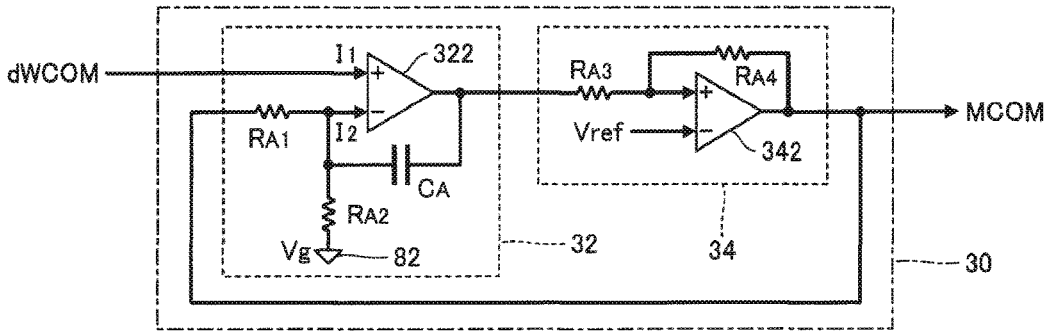
FIG. 24 is a configuration diagram of a modulation circuit in a modification example.

(1) In each of the above-described embodiments, the amplified signal ACOM generated by the digital power amplifier circuit 40 is fed back to the modulation circuit 30, but as illustrated in FIG. 24, it is also possible to feed back the modulated signal MCOM generated by the modulation circuit 30 to the input side of the modulation circuit 30. Specifically, the modulated signal MCOM generated by the comparison circuit 34 is fed back to the minus side input terminal I2 of the integration circuit 32 via the resistance element RA1. Even with the configuration in FIG. 24, pulse modulation by self-oscillation is realized by the modulation circuit 30.

In the configuration of each of the above embodiments (FIG. 4) in which the amplified signal ACOM is fed back to the input side of the modulation circuit 30, there is an advantage that variation of the power supply voltage Vdd used by the digital power amplifier circuit 40 for generating the amplified signal ACOM is compensated. That is, in a case where the power supply voltage Vdd varies for some reason, the modulation circuit 30 and the digital power amplifier circuit 40 operate so that the influence of the variation on the amplified signal ACOM is reduced. Therefore, even in a case where the power supply voltage Vdd varies, from the viewpoint of highly accurately generating the drive signal COM of the desired waveform, as exemplified in each of the above embodiments, a configuration is preferable, in which the amplified signal ACOM generated by the digital power amplifier circuit 40 is fed back to the input side of the modulation circuit 30.

Figure 25:
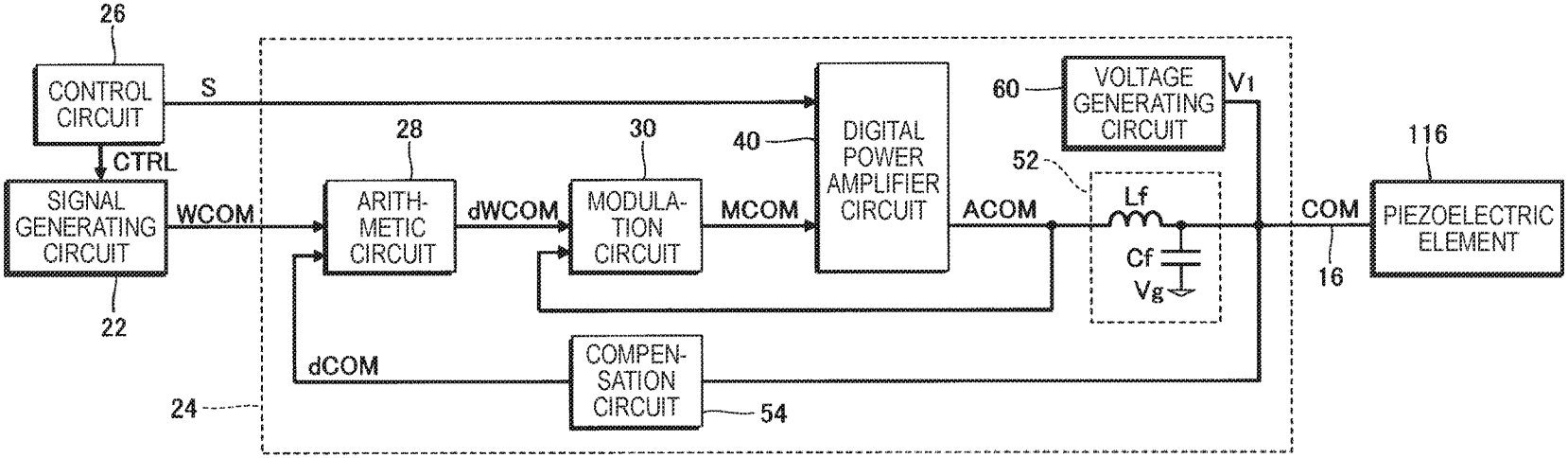
FIG. 25 is a configuration diagram of a drive circuit in the modification example.

(2) In each of the above-described embodiments, the initial voltage V1 generated by the voltage generating circuit 60 is supplied between the digital power amplifier circuit 40 and the smoothing circuit 52, but the point at which the initial voltage V1 is supplied is not limited to the above examples. For example, as illustrated in FIG. 25, it is also possible to supply the initial voltage V1 generated by the voltage generating circuit 60 to the output side of the smoothing circuit 52 (output terminal of the amplifier circuit 24).

Figure 26:
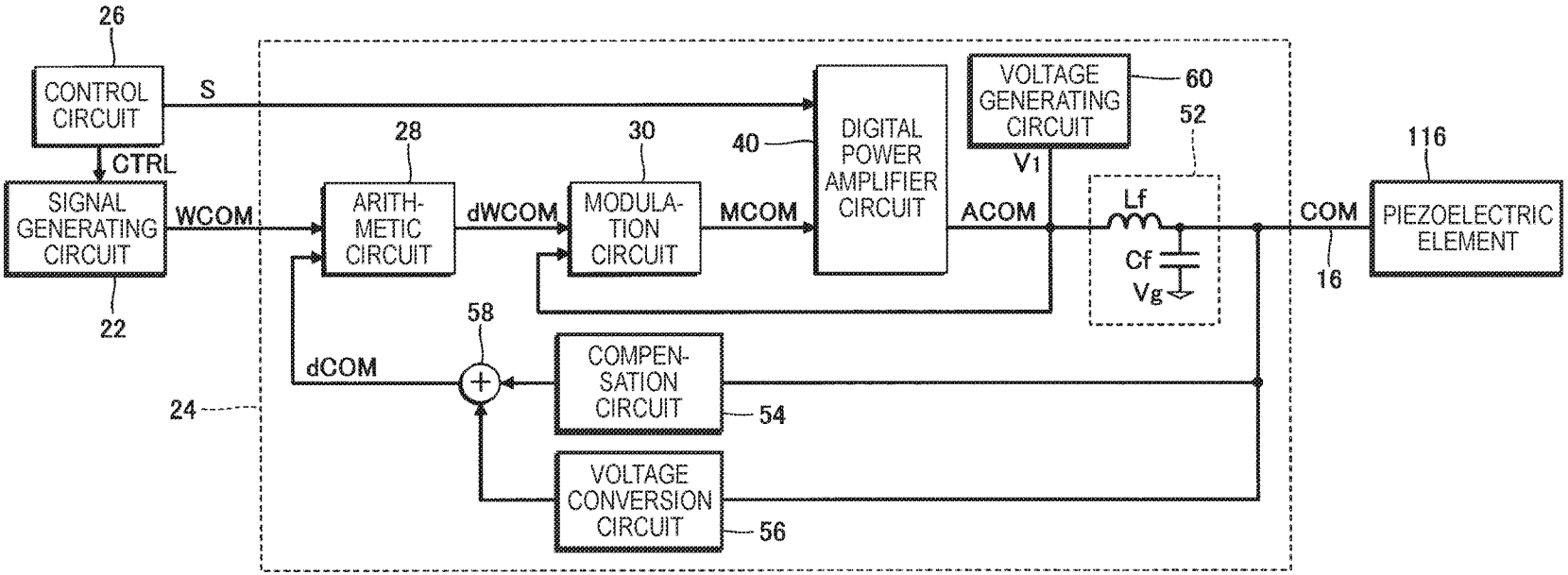
FIG. 26 is a configuration diagram of another drive circuit in the modification example.

(3) In each of the above-described embodiments, the compensation circuit 54 is disposed in the feedback path of the drive signal COM, but as illustrated in FIG. 26, it is also possible to add a voltage conversion circuit 56 and an addition circuit 58 to the feedback path of the drive signal COM. The voltage conversion circuit 56 is configured with, for example, a resistance element, and converts the voltage range of the drive signal COM so that the feedback signal dCOM becomes a voltage range suitable for processing by the arithmetic circuit 28. The addition circuit 58 adds the signal converted by the voltage conversion circuit 56 and the signal after processing by the compensation circuit 54 to generate the feedback signal dCOM. By feeding back the voltage information of the drive signal COM using the voltage conversion circuit 56, effects such as improvement of the output voltage accuracy of the drive signal COM and widening of the frequency band of the amplifier circuit 24 are realized.

Figure 27:
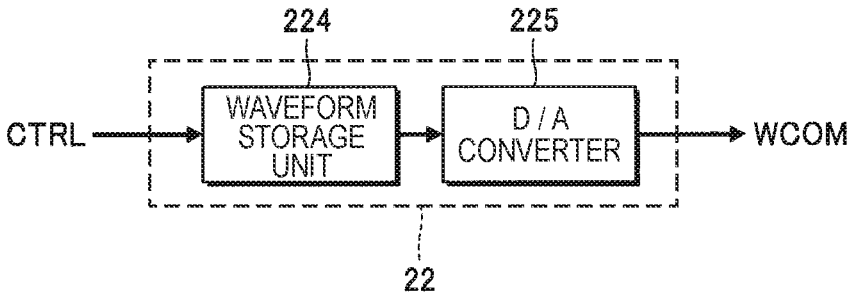
FIG. 27 is a configuration diagram of a signal generating circuit in the modification example.

(4) The configuration of the signal generating circuit 22 is not limited to the example in FIG. 3. For example, as illustrated in FIG. 27, it is also possible to configure the signal generating circuit 22 with a waveform storage unit 224 and a D/A converter 225. The waveform storage unit 224 is configured with a nonvolatile storage circuit such as a semiconductor recording medium and stores a plurality of waveform data (time series of sample values) representing the waveform of the drive waveform signal WCOM. The control circuit 26 outputs the waveform indication data CTRL specifying any of a plurality of waveform data stored in the waveform storage unit 224 to the signal generating circuit 22. The waveform storage unit 224 outputs the waveform data specified by the waveform indication data CTRL to the D/A converter 225. The D/A converter 225 generates an analog drive waveform signal WCOM by D/A conversion with respect to the waveform data supplied from the waveform storage unit 224.

Figure 28:
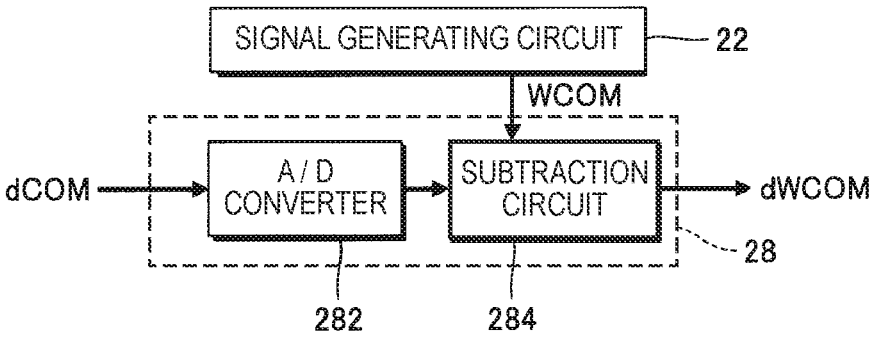
FIG. 28 is a configuration diagram of the signal generating circuit and an arithmetic circuit in the modification example.

In addition, as illustrated in FIG. 28, it is also possible to realize the signal generating circuit 22 and the arithmetic circuit 28 with a digital circuit. The signal generating circuit 22 in FIG. 28 generates a digital drive waveform signal WCOM. It is also possible to realize the signal generating circuit 22 in FIG. 28 as a function of the control circuit 26 realized by, for example, a CPU or the like. On the other hand, the arithmetic circuit 28 in FIG. 28 is configured to include an A/D converter 282 and a subtraction circuit 284. The A/D converter 282 converts the feedback signal dCOM generated by the compensation circuit 54 from analog to digital. The subtraction circuit 284 is a digital circuit that generates the difference signal dWCOM representing the difference between the digital drive waveform signal WCOM generated by the signal generating circuit 22 and the digital feedback signal dCOM generated by the A/D converter 282. Even with the configuration in FIG. 28, the same effects as those in each of the above-described embodiments are realized.

Figure 29:
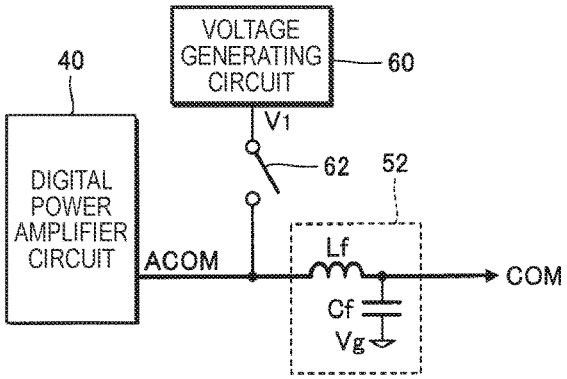
FIG. 29 is a partial configuration diagram of an amplifier circuit in the modification example.

(5) In each of the above-described embodiments, the voltage generating circuit 60 is fixedly connected between the digital power amplifier circuit 40 and the smoothing circuit 52, but as shown in FIG. 29, it is also possible to switch the supply of the initial voltage V1 by a switch 62. Specifically, in FIG. 12, the diode D is used as the backflow preventing element, but the switch 62 may be used instead of the diode D. For example, the control circuit 26 cuts off the supply of the initial voltage V1 by controlling the switch 62 to be in an OFF state in the preparation period QA and the stop period QC and supplies the initial voltage V1 by controlling the switch 62 to be in an ON state in the operation period QB. It is also possible to add the similar switch 62 to the configuration of FIG. 25.

In addition, each of the above-described embodiments is configured such that the initial voltage V1 generated by the voltage generating circuit 60 is supplied to the piezoelectric element 116 by setting the digital power amplifier circuit 40 to the stop state (shutdown state) in the preparation period QA and the stop period QC, and the drive signal COM based on the drive waveform signal WCOM is supplied to the piezoelectric element 116 by setting the digital power amplifier circuit 40 to the operation state in the operation period, but the invention is not limited thereto. For example, by providing a switch in the path between the digital power amplifier circuit 40 and the piezoelectric element 116 and controlling the operation of the switch, each of the above-described embodiments may be configured to select which of the initial voltage V1 and the drive signal COM based on the drive waveform signal WCOM is to be supplied to the piezoelectric element 116.

(6) In each of the above-described embodiments, the liquid ejection device 100A as a medical apparatus cutting living tissue by ejection of liquid is exemplified, but the specific form of the liquid ejection device according to the invention is not limited to the above examples. For example, the invention can also be applied to a liquid ejection device (that is, an ink jet printing apparatus) which ejects ink which is an example of liquid onto a medium such as printing paper.

Figure 30:
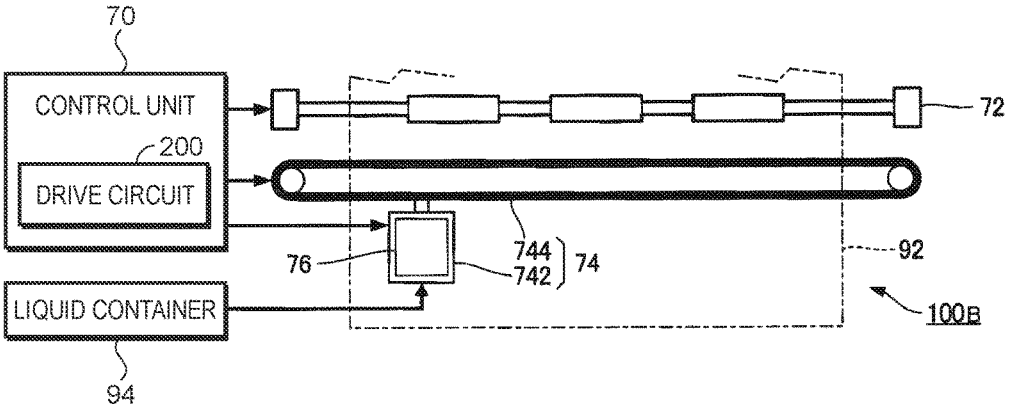
FIG. 30 is a configuration diagram of a liquid ejection device according to the modification example.

FIG. 30 is a schematic configuration diagram of a liquid ejection device 100B. The liquid ejection device 100B is an ink jet type printing apparatus that ejects ink stored in a liquid container 94 such as an ink cartridge or the like onto a medium 92 and includes a control unit 70, a transport mechanism 72, a movement mechanism 74, and a liquid ejection head 76 as exemplified in FIG. 30. The control unit 70 is a processing circuit for integrally controlling each element of the liquid ejection device 100B and includes the drive circuit 200 exemplified in each of the above-described embodiments. The transport mechanism 72 transports the medium 92 under the control of the control unit 70.

The movement mechanism 74 reciprocates the liquid ejection head 76 along a direction intersecting (typically orthogonal) to the transport direction of the medium 92 under the control of the control unit 70. The movement mechanism 74 in FIG. 30 includes a substantially box-shaped transport body (carriage) 742 for accommodating the liquid ejection head 76 and an endless belt 744 on which the transport body 742 is fixed. It is also possible to mount the liquid container 94 on the transport body 742.

The liquid ejection head 76 is an ink jet head which ejects ink supplied from the liquid container 94 onto the medium 92 from a plurality of nozzles (ejection holes) under the control of the control unit 70. Specifically, the liquid ejection head 76 includes a liquid chamber (pressure chamber) and a piezoelectric element (an example of the capacitive load) corresponding to each of the plurality of nozzles. Whether or not to supply the drive signal COM generated by the drive circuit 200 is individually controlled for each piezoelectric element. When the piezoelectric element deforms due to the supply of the drive signal COM, the pressure in the liquid chamber varies and the ink filled in the liquid chamber is ejected from the nozzles. In parallel with the transport of the medium 92 by the transport mechanism 72 and the repetitive reciprocation of the transport body 742, the liquid ejection head 76 ejects ink onto the medium 92 so that the desired image is formed on the surface of the medium 92.

In FIG. 30, the liquid ejection device 100B of a serial system type reciprocating the transport body 742 on which the liquid ejection head 76 is mounted is illustrated, but the invention can also be applied to a line type liquid ejection device in which a plurality of nozzles are distributed over the entire width of the medium 92. In addition, it is also possible to mount the drive circuit 200 on the liquid ejection head 76.

The application of the liquid ejection device is not limited to the above examples (the medical apparatus and the printing apparatus). For example, the liquid ejection device according to the invention can also be used as a device for manufacturing microcapsules containing chemical liquid, a manufacturing device for forming, for example, a color filter of a liquid crystal display device by ejecting a color material solution, or a manufacturing device for forming wirings or electrodes of a wiring substrate by ejecting a conductive material solution.

(7) Each of the above-described embodiments is configured such that the feedback signal dCOM that advances the phase of the drive signal COM is fed back, but the feedback signal dCOM is not limited thereto. The feedback signal dCOM may be fed back as both the one that advances the phase of the drive signal COM and the one that does not advance, only one which does not advance the phase of the drive signal COM may be fed back as the feedback signal dCOM.

(8) Each of the above embodiments is configured such that, in the preparation period QA, the control circuit 26 supplies the waveform indication data CTRL instructing the generation of the drive waveform signal WCOM where the drive signal COM becomes the base voltage V2 to the signal generating circuit 22, and the signal generating circuit 22 generates the drive waveform signal WCOM according to the waveform indication data CTRL, the invention is not limited thereto. A configuration in which the control circuit 26 does not supply the waveform indication data CTRL to the signal generating circuit 22 in the preparation period QA (that is, a configuration in which the waveform indication data CTRL is supplied to the signal generating circuit 22 only in the operation period QB) may be adopted.

The entire disclosure of Japanese Patent Application No. 2016-193306 filed Sep. 30, 2016 is expressly incorporated by reference herein.

What is claimed is:

1. A drive circuit that generates a drive signal supplied to a capacitive load, the drive circuit comprising:

a signal generating circuit that generates a drive waveform signal;

an arithmetic circuit that generates a difference signal representing a difference between the drive waveform signal and a feedback signal;

a modulation circuit that modulates a pulse of the difference signal to generate a modulated signal;

a digital power amplifier circuit that amplifies the modulated signal to generate an amplified signal;

a smoothing circuit that smoothes the amplified signal to generate the drive signal;

a compensation circuit that generates the feedback signal based on the drive signal; and a voltage generating circuit that is connected to a wiring between the digital power amplifier circuit and the capacitive load and generates a first voltage that is a voltage exceeding a voltage range in which a pulse frequency of the modulated signal does not vary with respect to the voltage variation of the drive signal, wherein the drive signal generated by operation of the digital power amplifier circuit is supplied to the capacitive load after the first voltage is supplied to the capacitive load as the drive signal.

2. The drive circuit according to claim 1, wherein the signal generating circuit generates the drive waveform signal in which the drive signal becomes a second voltage exceeding the voltage range in a case where the drive signal generated by operation of the digital power amplifier circuit is supplied to the capacitive load.

3. The drive circuit according to claim 2, wherein the signal generating circuit generates the drive waveform signal in which the drive signal becomes the second voltage exceeding the voltage range in a state in which the operation of the digital power amplifier circuit is stopped.

4. The drive circuit according to claim 2, wherein the second voltage is a voltage equal to or greater than the first voltage.

5. The drive circuit according to claim 2, wherein the second voltage is a voltage lower than the first voltage.

6. The drive circuit according to claim 5, wherein the voltage generating circuit includes a backflow preventing element having one terminal connected to a voltage line to which a predetermined voltage is supplied and generates the first voltage from the voltage generated at the other terminal of the backflow preventing element, and the digital power amplifier circuit includes:

a first transistor provided between a first wiring to which a voltage on a high-level side is applied and an output point that outputs the amplified signal;

a second transistor provided between a second wiring to which a voltage on a low-level side lower than the voltage on the high-level side is applied and the output point; and a capacitive element provided between the other terminal of the backflow preventing element and the first transistor source.

7. The drive circuit according to claim 1, wherein the modulation circuit includes:

an arithmetic amplifier having a first input terminal to which the difference signal is input and a second input terminal to which the amplified signal or the modulated signal is input; and a resistance element connected to the second input terminal, and the voltage generating circuit generates the first voltage by dividing a voltage using the resistance element.

8. A liquid ejection device comprising:

a liquid chamber filled with liquid;

a nozzle communicating with the liquid chamber;

a piezoelectric element that applies pressure to the liquid in the liquid chamber; and a drive circuit that generates a drive signal supplied to the piezoelectric element, the drive circuit including:

a signal generating circuit that generates a drive waveform signal, an arithmetic circuit that generates a difference signal representing a difference between the drive waveform signal and a feedback signal, a modulation circuit that modulates a pulse of the difference signal to generate a modulated signal, a digital power amplifier circuit that amplifies the modulated signal to generate an amplified signal, a smoothing circuit that smoothes the amplified signal to generate the drive signal, a compensation circuit that generates the feedback signal based on the drive signal, and a voltage generating circuit that is connected to a wiring between the digital power amplifier circuit and the capacitive load and generates a first voltage that is a voltage exceeding a voltage range in which a pulse frequency of the modulated signal does not vary with respect to the voltage variation of the drive signal, wherein the drive signal generated by operation of the digital power amplifier circuit is supplied to the capacitive load after the first voltage is supplied to the capacitive load.

9. A method of controlling a drive circuit that generates a drive signal supplied to a capacitive load, the drive circuit including:

a signal generating circuit that generates a drive waveform signal, an arithmetic circuit that generates a difference signal representing a difference between the drive waveform signal and a feedback signal, a modulation circuit that modulates a pulse of the difference signal to generate a modulated signal, a digital power amplifier circuit that amplifies the modulated signal to generate an amplified signal, a smoothing circuit that smoothes the amplified signal to generate the drive signal, a compensation circuit that generates the feedback signal based on the drive signal, and a voltage generating circuit that is connected to a wiring between the digital power amplifier circuit and the capacitive load and generates a first voltage that is a voltage exceeding a voltage range in which a pulse frequency of the modulated signal does not vary with respect to the voltage variation of the drive signal, the method comprising:

supplying the drive signal generated by operation of the digital power amplifier circuit to the capacitive load after the first voltage is supplied to the capacitive load.

10. A drive circuit that generates a drive signal supplied to a capacitive load, the drive circuit comprising:

a signal generating circuit that generates a drive waveform signal;

an arithmetic circuit that generates a difference signal representing a difference between the drive waveform signal and a feedback signal;

a modulation circuit that performs pulse modulation of the difference signal to generate a modulated signal;

a digital power amplifier circuit that amplifies the modulated signal to generate an amplified signal;

a smoothing circuit that smoothes the amplified signal to generate the drive signal;

a compensation circuit that generates the feedback signal based on the drive signal; and a voltage generation circuit that is electrically connected to the digital power amplified circuit and the capacitive load, and that generates a first voltage that is a voltage exceeding a voltage range in which a pulse frequency of the modulated signal does not vary with respect to the voltage variation of the drive signal, wherein the drive signal generated by operation of the digital power amplified circuit is supplied to the capacitive load after the first voltage is supplied to the capacitive load.

* * * * *